US005432052A

United States Patent [19]

Ohshima

[11] Patent Number: 5,432,052

[45] Date of Patent: Jul. 11, 1995

[54] SILVER HALIDE COLOR PHOTOGRAPHIC PHOTO-SENSITIVE MATERIAL

[75] Inventor: Naoto Ohshima, Kanagawa, Japan

[73] Assignee: Fuji Photo Film Co., Ltd., Kanagawa, Japan

[21] Appl. No.: 223,447

[22] Filed: Apr. 5, 1994

[30] Foreign Application Priority Data

Apr. 5, 1993 [JP] Japan ..... 5-101973

[51] Int. Cl.[6] ..... G03C 1/08; G03C 1/34

[52] U.S. Cl. ..... 430/567; 430/569; 430/603; 430/604; 430/611; 430/613

[58] Field of Search ..... 430/569, 567, 603, 613, 430/604, 611

[56] References Cited

U.S. PATENT DOCUMENTS

| | | | |
|---|---|---|---|
| 4,945,035 | 7/1990 | Keevert, Jr. et al. | 430/569 |
| 4,983,508 | 1/1991 | Ishiguro et al. | 430/569 |
| 5,024,932 | 6/1991 | Tanji et al. | 430/569 |
| 5,070,008 | 12/1991 | Maekawa et al. | 430/569 |

FOREIGN PATENT DOCUMENTS

| | | |
|---|---|---|
| 1105940 | 4/1989 | Japan . |
| 31135 | 1/1991 | Japan . |
| 3132647 | 6/1991 | Japan . |
| 49035 | 1/1992 | Japan . |
| 4283742 | 10/1992 | Japan . |

*Primary Examiner*—Thorl Chea

*Attorney, Agent, or Firm*—Sughrue, Mion, Zinn, Macpeak & Seas

[57] ABSTRACT

In a silver halide color photographic photo-sensitive material comprising a reflective support having thereon photographic structural layers comprising one or more photo-sensitive silver halide emulsion layers, pH of a coating of the silver halide color photographic photo-sensitive material ranges from 4.0 to 6.5. The photo-sensitive silver halide emulsion layer contains a mercapto heterocyclic compound and silver halide grains, each comprising silver chlorobromide or silver chloride and containing substantially no silver iodide. The silver halide grains are formed in the presence of a specific grain growth controlling agent. The silver halide grain contains a metal complex of Ir.

15 Claims, No Drawings

SILVER HALIDE COLOR PHOTOGRAPHIC PHOTO-SENSITIVE MATERIAL

BACKGROUND OF THE INVENTION

The present invention relates to a silver halide color photographic photo-sensitive material. More particularly, the present invention relates to a silver halide color photographic photo-sensitive material which is highly sensitive to light, is excellent in storability and is improved in pressure induced desensitization.

Color photography is a process of producing dye images achieved by using a photo-sensitive material comprising a support having thereon photographic structural layers comprising a silver halide emulsion and dye forming couplers. The photo-sensitive material is subjected to development processing with an aromatic primary amine color developing agent, resulting in production of an oxidation product of the developing agent. The dye images are formed by reaction of this oxidation product with the dye forming couplers.

Simplified and rapid color development processing is a strong requirement of the color photographic field and various improvements have been achieved. Advanced faster systems have been developed one after another in a cycle of a few years.

To increase a processing speed requires a further approach to shortening time for each of color development, bleach-fixing, washing with water and drying processes. A method of increasing the processing speed is disclosed in, for example, International Patent Publication No. WO 87/04534. This publication discloses a method of rapid processing by using a color photographic photo-sensitive material comprising high silver chloride emulsion. From the viewpoint of the rapid processing, it would be preferable to use the high silver chloride emulsion.

Such efforts yield a technique of printing images of a color negative on a silver halide color photographic printing paper for high silver chloride printing, which has become a common method for simple and easy production of high-quality images.

The higher contents of the silver chloride in the silver halide emulsion to be used result in a far advance in a development speed. The silver chloride emulsion is, however, found to have a disadvantage of lower photo-sensitivity. With this respect, various techniques and methods are disclosed to improve the photo-sensitivity of such the high silver chloride silver halide emulsion, and thereby to overcome the above mentioned problem.

Under normal conditions for forming grains, silver chloride emulsion grains suitable for rapid processing are cubic in shape mainly having {100} faces. However, various attempts have been made to exhibit some characteristics and performances including high sensitivity that are lacking or unavailable in the cubic grains by means of forming octahedral or tabular grains mainly having (111) faces using various grain growth controlling agents.

In particular, it has been found that highly sensitive emulsion can be obtained with grain growth controlling agents disclosed in JP-A-2-32 (the term "JP-A" as used herein means an "unexamined" published Japanese patent application), JP-A-212639 and JP-A-4-283742.

The present inventor prepared the octahedral and tabular grains mainly having (111) faces by using the above mentioned specific grain growth controlling agent to study and examine availability of a highly sensitive high silver chloride emulsion. As a result, it has revealed that the high silver chloride emulsion formed by using the specific grain growth controlling agent that contains octahedral or tabular grains mainly having (111) faces is highly sensitive but photo-sensitive materials to which the emulsion in question is applied are suffered from a problem of increase of fogging density during a long period of storage. There is a noticeable increase in the fogging density of the photo-sensitive material subjected to the long period of storage when a color developer contaminated with a bleach-fixing solution is used during a continuous color processing. This is a serious problem in practical applications considering a storage period up to when the photo-sensitive material is used, after being prepared, in the field of processing laboratory as well as considering a possibility of change in composition of a processing solution.

As a method of achieving this high sensitivity, for example, JP-A-2-20853 discloses that the high sensitivity can be achieved by means of doping a high silver chloride emulsion with a six-coordination complex of Re, Ru or Os having at least four cyan ligands. JP-A-1-105940 discloses that an emulsion having excellent reciprocity law properties can be obtained without deterioration of latent image stability at a few hours after exposure by using an emulsion containing high silver chloride grains having silver bromide rich regions in which iridium (Ir) is selectively doped. JP-A-3-132647 discloses that a high silver chloride emulsion that contains iron ions contributes to production of a highly sensitive, hard gradation photo-sensitive material of which sensitivity is less affected by fluctuation of temperature or intensity of illumination during exposure, and contributes to reduction of pressure induced desensitization of the material when pressure is applied to it. JP-A-4-9034 and JP-A-4-9035 disclose that such a photo-sensitive material can be obtained that is highly sensitive and is less in reciprocity, and that has good latent image storability with less pressure fogging by using a high silver chloride emulsion that contains a specific metal complex having at least two cyan ligands. JP-A-62-253145 discloses that such a silver halide photographic photo-sensitive material can be obtained that is less affected by the pressure fogging or the pressure induced desensitization and that is suitable for rapid processing by means of containing metal ions in the high silver chloride emulsion having a silver bromide rich phase.

On the other hand, JP-A-2-6940 and U.S. Pat. No. 4,917,994 disclose that increase of fogging of photo-sensitive materials can be restricted by means of adjusting pH of the coating of the materials. In addition, JP-A-2-135338 and JP-A-3-1135 disclose that to keep pH of a coating of photo-sensitive materials at a specific level restricts fogging and change in photo-sensitivity during storage of the photo-sensitive material.

However, none of the above mentioned techniques has led to a method of restricting increase of the fogging density and the pressure induced desensitization of the aforementioned specific high silver chloride emulsions, especially increase of the fogging density after a long period of storage that becomes notable when the color developer contaminated with a bleach-fixing solution is used in a continuous color processing.

Accordingly, an object of the present invention is to provide a silver halide color photographic photo-sensitive material which is highly sensitive to light, is excellent in storability, is improved in pressure induced desensitization.

SUMMARY OF THE INVENTION

The above mentioned object can be achieved with a silver halide color photographic photo-sensitive material.

According to one aspect of the present invention, it is provided with a silver halide color photographic photo-sensitive material comprising a reflective support having thereon photographic structural layers comprising one or more photo-sensitive silver halide emulsion layers, wherein pH of a coating of the silver halide color photographic photo-sensitive material ranges from 4.0 to 6.5 and wherein at least one of the silver halide emulsion layers contains at least one mercapto heterocyclic compound and silver halide grains, said sliver halide grains comprising silver chlorobromide or silver chloride and containing substantially no silver iodide, the silver halide grains having a silver chloride content of 80 mol % or higher, the silver halide grain being formed in the presence of at least one compound selected from the group consisting of compounds represented by the following general formula (I), (II), (III) and (IV), and the silver halide grain containing at least one compound selected from the group consisting of metal complexes of Fe, Ru, Re, Os and Ir.

(I)

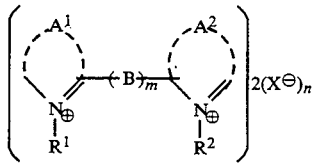

(II)

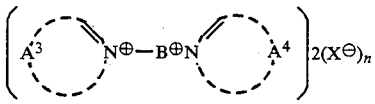

wherein $A^1$, $A^2$, $A^3$ and $A^4$ are same as or different from each other and each represents a group of nonmetallic atoms required for completing a nitrogen-containing heterocyclic ring; B represents a divalent bonding group; m represents 0 or 1; $R^1$ and $R^2$ each represents an alkyl group; X represents an anion; and n represents 0 or 1, in which n represents 0 when the compound is an inner salt.

(III)

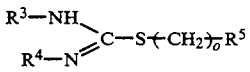

wherein $R^3$ and $R^4$ are same as or different from each other and each represents a hydrogen atom, an aryl group or an aralkyl group; $R^5$ represents an amino group, a sulfonic acid group or a carboxyl group; and o represents an integer of from 1 to 5.

$$X—L^1—(S—L^2)p—X.qZ \quad (IV)$$

wherein X represents an amino group which may be substituted by an alkyl group, a quaternary alkyl ammonium group or a carboxyl group; $L^1$ and $L^2$ each represents a divalent organic group formed of a single or a combination of an alkylene group, an alkenylene group, $—SO_2—$, —SO—, —O—, —CO— or —N(R)— (R represents a hydrogen atom, an alkyl group, an aryl group or $—L^3—(S—L^4)p—X$, in which $L^3$ and $L^4$ each represents an alkylene group, an alkenylene group, $—SO_2—$, —SO—, —O—, or —CO—); p represents an integer of from 1 to 5; q represents an integer of from 0 to 3; and Z represents an anion, where q is equal in number to the quaternary alkyl ammonium group. The silver halide grains are preferably formed in the presence of (I) or (III).

Preferably, 50% or more, based on an outer surface area, of the silver halide grains is constituted by (111) planes. In addition, it is preferable that 80% or more of total number of silver halide grains are octahedral silver halide grains. The metal complex is preferably Ir complex or a metal complex having at least two cyan ligands.

The silver halide color photographic photo-sensitive material according to the present invention permits simultaneous achievement of the higher sensitivity, the excellent storability, i.e., restriction of increase of the fogging density during a long storage period of the photo-sensitive material and improvement of the pressure induced desensitization.

DETAILED DESCRIPTION OF THE INVENTION

The present invention is described in detail below.

A silver halide grain according to the present invention is required to comprise silver chlorobromide or silver chloride and contains substantially no silver iodide. The silver halide grain is also required to have silver chloride contents of 80 mol % or higher. However, each silver halide grain preferably has the silver chloride contents of 90 mol % or higher, and more preferably, 95 mol % or higher. In a most preferably case, the silver halide grain comprises silver chlorobromide or silver chloride and contains substantially no silver iodide, and the silver halide grain has the silver chloride contents of 99 mol % or higher. The term "contains substantially no silver iodide" used herein means the silver iodide contents of lower than 1.0 mol %, and preferably 0 mol %.

A compound used in the present invention is described in detail that is selected from the group consisting of (I) and (II).

(I)

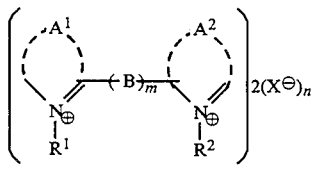

(II)

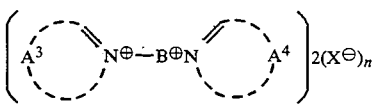

wherein $A^1$, $A^2$, $A^3$ and $A^4$ are same as or different from each other and each represents a group of nonmetallic atoms required for completing a nitrogen-containing heterocyclic ring; B represents a divalent bonding group; m represents 0 or 1; $R^1$ and $R^2$ each represents an alkyl group; X represents an anion; and n represents 0 or 1, in which n represents 0 when the compound is an inner salt.

In the formulae (I) and (II), $A^1$, $A^2$, $A^3$ and $A^4$ are same as or different from each other and each represents a group of nonmetallic atoms required for completing a nitrogen-containing heterocyclic ring. As a hetero atom, an oxygen atom, a nitrogen atom and/or a sulfur atom may be contained. A benzene ring may be condensed to the heterocyclic ring. The heterocyclic ring completed by $A^1$, $A^2$, $A^3$ or $A^4$ may have one or more substituent, in which the substituent(s), if any, of the individual heterocyclic rings may be same as or different from each other. Examples of the substituent include: an alkyl group, an aryl group, an aralkyl group, an alkenyl group, a halogen atom, an acyl group, an alkoxycarbonyl group, an aryloxycarbonyl group, a sulfonic acid group, a carboxyl group, a hydroxyl group, an alkoxy group, an aryloxy group, an amide, a sulfamoyl group, a carbamoyl group, an ureido group, an amino group, a sulfonyl group, a cyano group, a nitro group, a mercapto group, an alkylthio group, and an arylthio group. Preferable examples of the nitrogen-containing heterocyclic ring include five- and six-membered rings such as a pyridine ring, an imidazole ring, a thiazole ring, an oxazole ring and a pyrimidine ring. The pyridine ring is more preferable.

B represents a divalent bonding group. The divalent bonding group may be, for example, a single or a combination of alkylene, arylene, alkenylene, $—SO_2—$, —SO—, —O—, —S—, —CO— or $—NR^3—$ ($R^3$ represents an alkyl group, an aryl group or a hydrogen atom). The bonding group may be substituted by a substituent such as a hydroxyl group. Preferable examples of B include alkylene and alkenylene.

$R^1$ and $R^2$ each represents an alkyl group preferably having from 1 to 20, both inclusive, carbon atoms. $R^1$ and $R^2$ may be same as or different from each other.

The alkyl group includes substituted and unsubstituted alkyl groups. The substituents may be those substituents which are used in the nitrogen-containing heterocyclic ring completed by $A^1$, $A^2$, $A^3$ or $A^4$ as described above.

The more preferable example of $R^1$ and $R^2$ each is an alkyl group having from 4 to 10 carbon atoms. An alkyl group substituted by a substituted or unsubstituted aryl group is most preferable.

X represents an anion, of which specific examples include a chlorine ion, a bromine ion, an iodine ion, a nitrate ion, p-toluenesulfonate, and oxalato. n represents 0 or 1, in which n represents 0 when the compound is an inner salt.

The compounds represented by the general formulae (I) and (II), respectively, may be synthesized through a method disclosed in JP-A-2-32.

Specific examples of the compound represented by the general formula (I) or (II) are given below. It should be noted that the present invention is not limited to those specific examples.

(1)

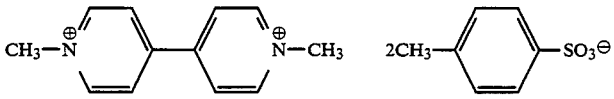

(2)

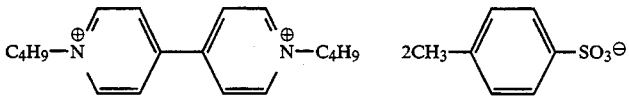

(3)

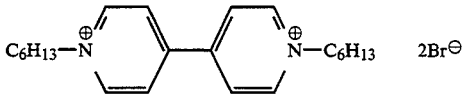

(4)

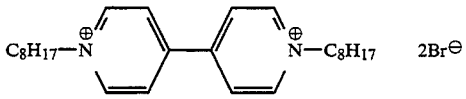

(5)

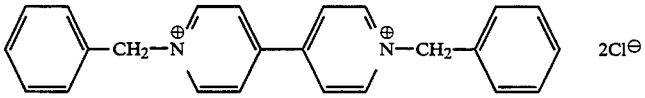

(6)

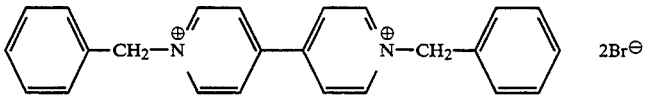

(7)

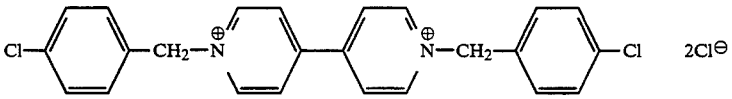

(8)

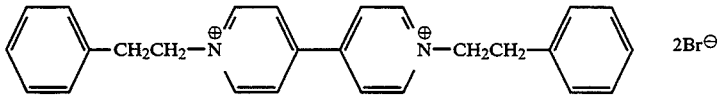

-continued
(9)
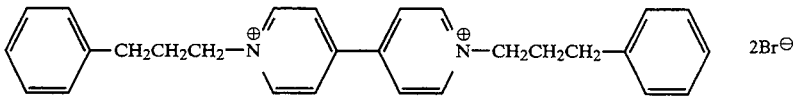
(10)
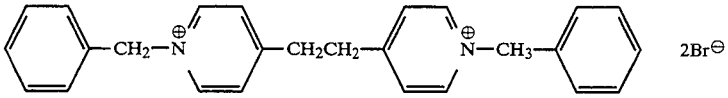
(11)
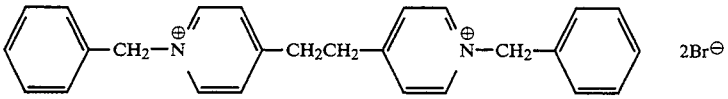
(12)
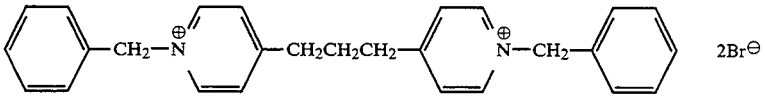
(13)
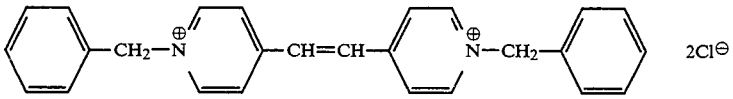
(14)
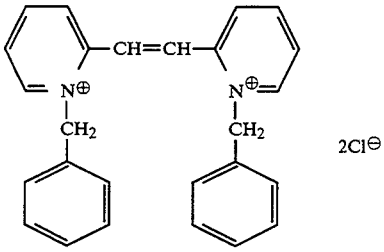
(15)
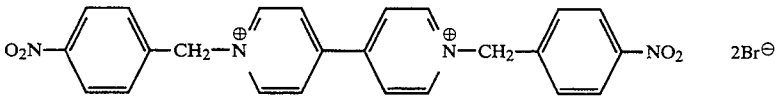
(16)
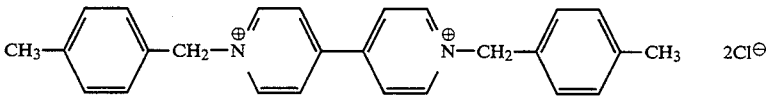
(17)
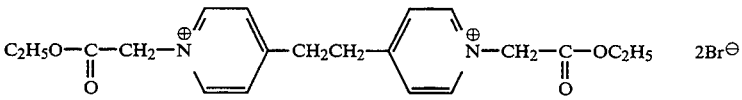
(18)
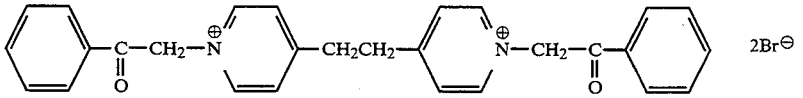
(19)
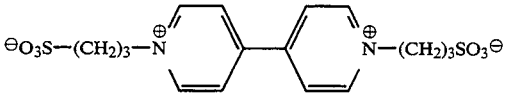
(20)
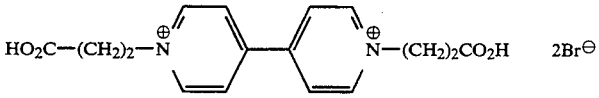

-continued
(21)
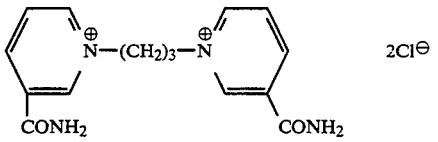
(22)
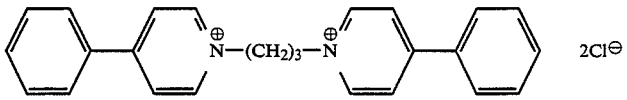
(23)
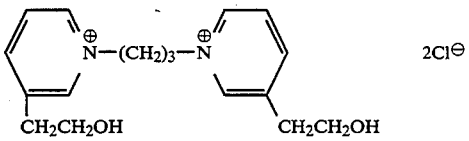
(24)
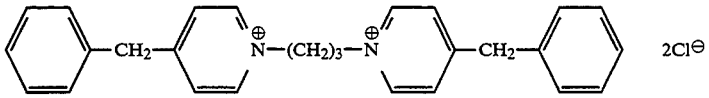
(25)
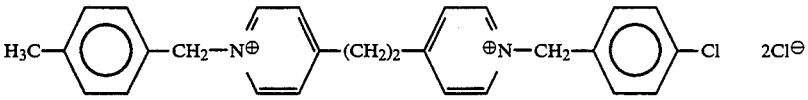
(26)
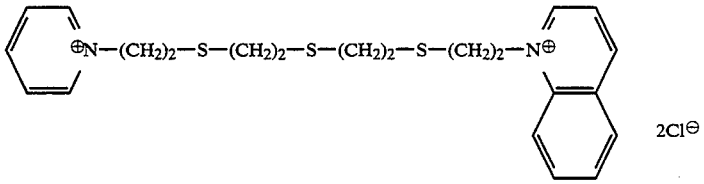
(27)
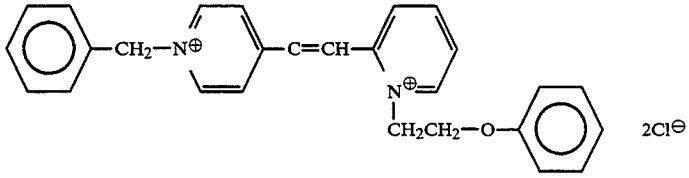
(28)
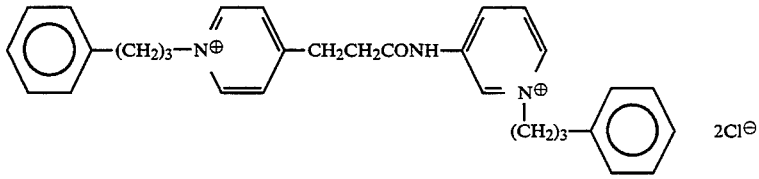
(29)
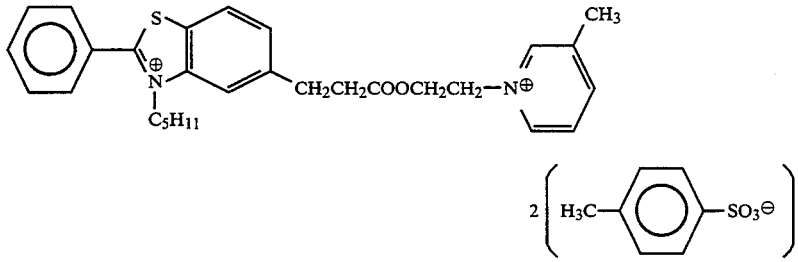

-continued (30)

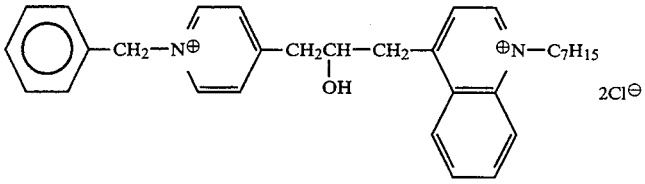

(31)

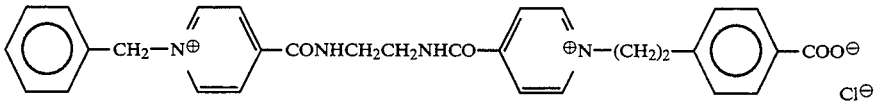

(32)

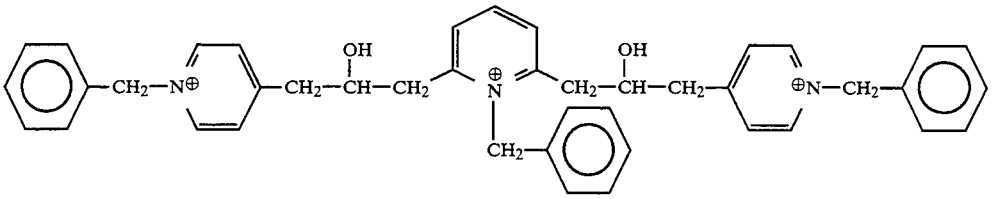

The compound represented by the general formula (III) which is used in-the present invention is described in detail.

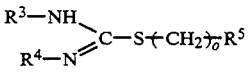

(III)

wherein $R^3$ and $R^4$ are same as or different from each other and each represents a hydrogen atom, an aryl group or an aralkyl group; $R^5$ represents an amino group, a sulfonic acid group or a carboxyl group; and o represents an integer of from 1 to 5.

$R^3$ and $R^4$ each represents a hydrogen atom, an aryl group or an aralkyl group which may be substituted by one or more substituents. $R^3$ and $R^4$ are same as or different from each other. A substituent for a phenyl moiety of the aryl or aralkyl group may be an alkyl group (e.g., a methyl group, an ethyl group, etc.), a hydroxyl group, a carboxyl group or a halogen atom (e.g., Cl, Br, etc.). Preferably, $R^3$ and $R^4$ are each a hydrogen atom or a phenyl group.

$R^5$ represents an amino group, a sulfonic acid group or a carboxyl group. The amino group may be substituted by alkyl, in which the alkyl group has from 1 to 5 carbon atoms. Preferably, $R^5$ is an unsubstituted amino group or an amino group substituted by methyl.

o represents an integer of from 1 to 5, preferably from 2 to 3.

The compound represented by the general formula (III) which is used in the present invention may be obtained by means of reacting a halogen compound with a thiourea derivative. The compound may be synthesized through a method disclosed in, for example, R. O. Clinton et al., J. Am. Chem. Soc., vol. 70, page 950 (1948) or D. G. Doherty et al., J. Am. Chem. Soc., vol. 79, page 5670 (1957). Alternatively, it may be synthesized through a method disclosed in JP-A-4-283742.

Specific examples of the compound represented by the general formula (III) is given below. It should be noted that the present invention is not limited to those specific examples.

III-1

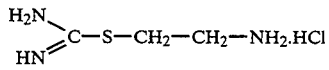

III-2

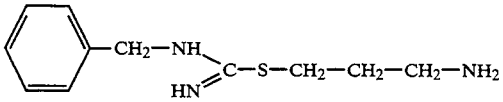

III-3

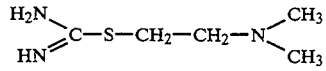

III-4

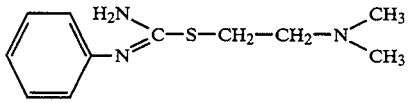

III-5

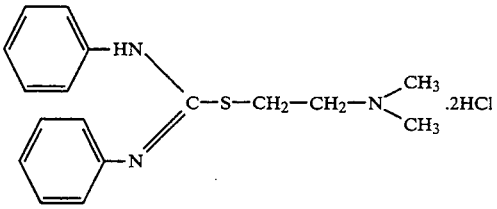

III-6

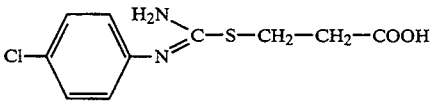

III-7

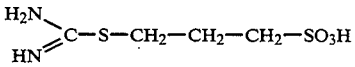

III-8

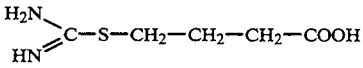

The compound represented by the general formula (IV) which is used in the present invention is described in detail.

$$X—L^1—(S—L^2)p—X.qZ \quad (IV)$$

wherein X represents an amino group which may be substituted by an alkyl group, a quaternary alkyl ammonium group or a carboxyl group; $L^1$ and $L^2$ each represents a divalent organic group formed of a single or a combination of an alkylene group, an alkenylene group, $—SO_2—$, —SO—, —O—, —CO— or —N(R)— (R represents a hydrogen atom, an alkyl group, an aryl group or $—L^3—(S—L^4)p—X$, in which $L^3$ and $L^4$ each represents an alkylene group, an alkenylene group, $—SO_2—$, —SO—, —O—, or —CO—); p represents an integer of from 1 to 5; q represents an integer of from 0 to 3; and Z represents an anion, where q is equal in number to the quaternary alkyl ammonium group.

When X represents an amino group which may be substituted by alkyl or a quaternary alkyl ammonium group, the alkyl group may further have one or more substituents. The substituent may be an alkylthio group, a hydroxyl group, a carboxyl group, a sulfonic acid group, a phosphono group or a halogen atom. A preferable example of X is an amino group which may be substituted by alkyl. The number of carbon atoms in the alkyl group is preferably from 1 to 3. If being an alkylene group, $L^1$, $L^2$, $L^3$ and $L^4$ may be substituted. A substituent for the alkylene group may be a hydroxyl group, a carboxyl group, a sulfonic acid group, a phosphono group or a halogen atom. Preferably, $L^1$ and $L^2$ are each a divalent organic group formed of a single or a combination of an alkenylene group which may be substituted, —O—, —CO— or —N(R)—.

More preferable example of each of $L^1$ and $L^2$ is a divalent organic group formed of a single or a combination of an alkylene group which may be substituted or —N(R)— where R represents a hydrogen atom, an alkyl group or $—L^3—(S—L^4)p—X$, in which $L^3$ and $L^4$ are each preferably an alkylene.

The number of carbon atoms in the alkylene which may be substituted is preferably from 1 to 5. p is preferably from 1 to 4. An anion represented by Z may be, for example, a chlorine ion, a bromine ion, an iodine ion, a nitrate ion, a sulfurate ion, p-toluenesulfonate or oxalato.

The compound represented by the general formula (IV) is known in JP-A-3-212639.

Specific examples of the compound represented by the general formula (IV) is given below. It should be noted that the present invention is not limited to those specific examples.

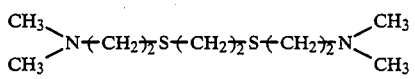
IV-1

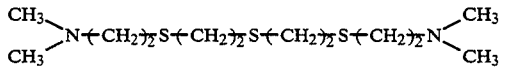
IV-2

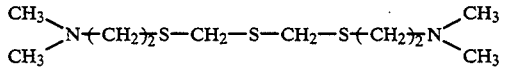
IV-3

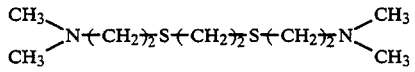
IV-4

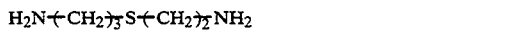
IV-5

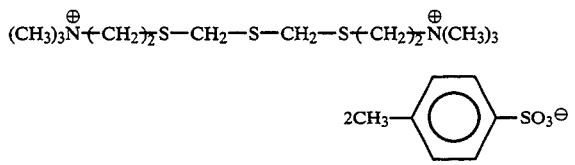
IV-6

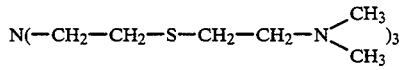
IV-7

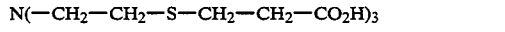
IV-8

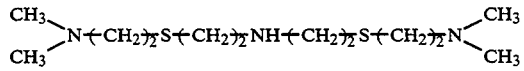
IV-9

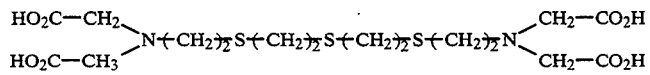
IV-9

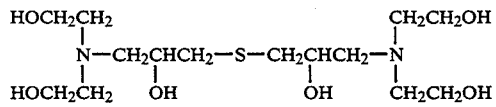
IV-11

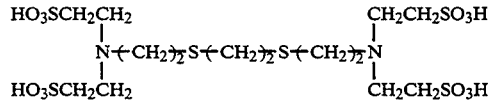
IV-12

-continued

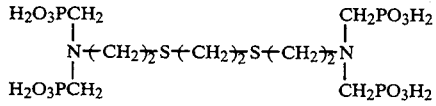

IV-13

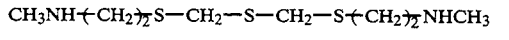

IV-14

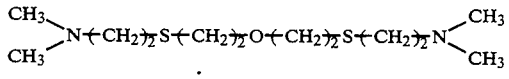

IV-15

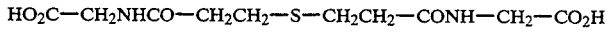

IV-16

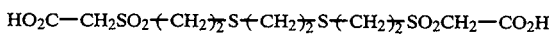

IV-17

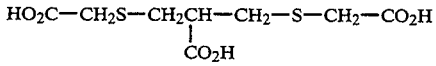

IV-18

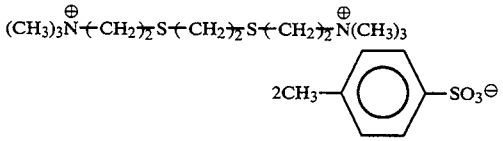

IV-19

The compound represented by the general formula (I), (II), (III) or (IV) may be added in any stages before termination of grain formation. However, the compound is preferably added previous to initiation of the grain formation. An amount of the above mentioned compound added is preferably in a range from $10^{-6}$ mol to $10^{-1}$ mol, and more preferably in a range from $10^{-5}$ mol to $5\times10^{-2}$ mol per one mol of the silver halide. These compounds are preferably added with being dissolved in water or an adequate solvent such as an organic solvent.

To achieve effects of the present invention, the compound represented by the general formula (I), (II) or (III) is preferable and the compound represented by the general formula (I) or (III) is more preferable of the compounds represented by the general formulae (I), (II), (III) and (IV).

In each silver halide grain according to the present invention, 50% or more, based on an outer surface area thereof is preferably constituted by (111) planes. A ratio of the surface area of the (111) planes to entire outer surface area is preferably 80% or higher, more preferably 90% or higher and most preferably 95% or higher. The ratio of the surface area of the (111) planes to entire outer surface area is defined as follows: an electron microphotograph of the silver halide grains (the number of the grains is at least 50 or more) is taken, and thereby calculating a ratio of a sum of the (111)-plane surface areas of the grains to a sum of entire grain surface areas of the grains. Whether a certain face is formed of the (111) plane may be determined geometrically or crystallographically.

The silver halide grain according to the present invention may be a normal crystal such as an octahedron or tetradecahedron or may be a twinning crystal such as a tabular grain. The silver halide grains may be a mixture of crystals having various shapes. However, it is preferable that 80% or more of all silver halide grains are octahedral silver halide grains.

The halogen composition of the emulsion may be different from grain to grain or same for all grains. However, to use an emulsion comprising the grains having the same halogen composition facilitates achievement of uniform properties of the grains. For distribution of the halogen composition in the silver halide emulsion grain, the grain may be a so-called uniform-structured grain in which the composition is identical at any portion of the silver halide grain. Alternatively, the grain may be so-called core-shell grain comprising a core in the internal part of the silver halide grain and a shell (one or more layers) enclosing the core which are different from each other in the halogen composition. In addition, also applicable are any other grains having two or more non-layer phases in the internal part or on the surface thereof which are different from each other in the halogen composition. The non-layer phase on the surface of the grain, if any, results from bonding of a layer having unlike composition to an edge, a corner or a surface. Either the latter two types of grains can advantageously be used rather than the uniform-structured grain for achieving high sensitivity and are also preferable by the pressure resistant considerations. When the silver halide grains having the above mentioned structure are used, a boundary between adjacent phases that are different from each other in the halogen composition may be a distinct boundary or an indistinct boundary with mixed crystals formed due to a difference in composition. In addition, the silver halide grain may be provided with actively a continuous structural change.

In the high silver chloride emulsion according to the present invention, the grain preferably has a silver bromide localized phase of a layer shape or a non-layer shape in the internal part or on the surface of the silver halide grain. The halogen composition of the localized phase is preferably at least 10 mol %, and more preferably higher than 20 mol %, based on the silver bromide content. The localized phase may exist in the internal part, on an edge, corner or surface of the grain. A preferable example of the localized phase is grown epitaxially on the corner of the grain.

On the other hand, the uniform-structured grains having a narrow range of the halogen composition distribution in each grain are also advantageously used in the high silver chloride emulsion having the silver halide contents of 90 mol % or higher to restrict as hard as possible deterioration of the sensitivity of the photo-sensitive material when pressure is applied to it.

An average grain size (an average of grain sizes each corresponding to a diameter of a circle equivalent to a projection area of the grain) of the silver halide grains contained in the silver halide emulsion used in the present invention preferably ranges from 0.1 μm to 2 μm.

The emulsion is preferably so-called mono-dispersed in which a grain size distribution is 20% or less, preferably 15% or less expressed as a fluctuation coefficient (obtained by dividing a standard deviation of the grain size distribution by the average grain size). In this event, the above mentioned mono-disperse emulsions may be blended in a same layer or laminated to achieve a wide latitude.

A silver chlorobromide emulsion used in the present invention may be prepared through a method disclosed in, for example, P. Glafkides, "Chimie et Phisique Photographique (Photographic Chemistry and Physics)," Paul Montel, 1967; G. F. Duffin, "Photographic Emulsion Chemistry," Focal Press, 1966; and V. L. Zelikman et al., "Making and Coating Photographic Emulsion," Focal Press, 1964. More specifically, the silver chlorobromide emulsion may be prepared according to any one of an acid method, a neutral method and an ammonium method. If such a technique is used that a soluble silver salt and a soluble halogen salt are reacted with each other, any one of one-side mixing, simultaneous mixing and a combination thereof may be used. Alternatively, a method where the grains are formed in an atmosphere with excessive silver ions (so-called reverse mixing) may be used. As one form of the simultaneous mixing, a so-called controlled double jet method may be used where pAg in a liquid phase formed of the silver halide is kept constant. With this method, the silver halide grains obtained have regular crystal shapes and are approximately uniform in grain sizes.

All silver halide emulsions used in the present invention are subjected to normal chemical sensitization and spectral sensitization.

For the chemical sensitization method, it is possible to use simultaneously chemical sensitization with chalcogens such as sulfur sensitization, selenium sensitization and tellurium sensitization, noble metal sensitization represented by gold sensitization, and reduction sensitization. Compounds advantageously used in the chemical sensitization are disclosed in JP-A-62-215272, page 18, a lower right column, to page 22, an upper right column.

The spectral sensitization is directed to apply spectral sensitivity to a desired range of wavelength to the emulsion in each layer of the photo-sensitive material according to the present invention. In the present invention, it is preferable that the spectral sensitization is applied by means of adding dyes—spectral sensitized dyes to the emulsion that absorb light having wavelengths involved in target spectral sensitivity. The spectral sensitized dyes used are disclosed in, for example, John Heterocyclic compounds—Cyanine dyes and related compounds, John Wiley & Sons, New York/London, 1964. Specific example of the compounds and a method of the spectral sensitization are disclosed in the above mentioned specification, JP-A-62-215272, page 22, an upper right column to page 38.

Various compounds and precursors thereof may be added to the silver halide emulsion used in the present invention to avoid fogging during manufacture process, storage or photographic processing of the photo-sensitive material or to stabilize photographic performance. A specific example of these compounds is disclosed in JP-A-62-215272, pages 39–72.

The emulsion used in the present invention is a so-called surface latent image type emulsion with which latent images are mainly formed on the surface of the grains.

The silver halide grains according to the present invention contain the metal complex of Fe, Ru, Re, Os or Ir.

An amount of the metal complex added varies depending on the type thereof but is preferably in a range from $10^{-9}$ mol to $10^{-2}$ mol, and more preferably in a range from $10^{-8}$ mol to $10^{-4}$ mol per one mol of the silver halide.

The metal complex used in the present invention may be added to the silver halide grains in any stages before and after preparation of them, i.e., nucleation, growth, physical ripening and chemical sensitization. The metal complex may be added at once or at several times. The metal complex used is preferably dissolved in water or an adequate solvent.

Of the metal complexes applicable to the present invention, iridium complex is especially preferable. Following are examples of trivalent or tetravalent iridium complex used to contain the iridium complex in the silver halide emulsion grains. However, the present invention is not limited to those specific examples. Hexachloroiridium (III) or (IV) Complex Salt and Hexaamineiridium (III) or (IV) Complex Salt An amount of the iridium complex added is preferably in a range from $10^{-9}$ mol to $10^{-4}$ mol, and more preferably in a range from $10^{-8}$ mol to $10^{-5}$ mol per one mol of the silver halide except for a case where the iridium complex comprises at least two cyan ligands set forth below.

The metal complex contained in the silver halide emulsion grains used in the present invention that is advantageously used is at least one selected from the group consisting of metal complexes of Fe, Ru, Re, Os and Ir each comprising at least two cyan ligands, by the considerations that high sensitivity can be achieved and that formation of the fogging can be restricted even during a long-time storage of a raw photo-sensitive material. The metal complex is represented by the following general formula.

$$[M^1(CN)_{6-a}La]^n,$$

wherein $M^1$ represents Fe, Ru, Re, Os or Ir, L represents a ligand other than CN, a represents 0, 1 or 2, and n represents −2, −3 or −4.

Examples of the metal complex comprising at least two cyan ligands that is used in the present invention are set forth below. As a counter ion to the metal complex, alkali metal ions are advantageously used such as ammonium, sodium and potassium.

Metal Complex with two or more Cyan Ligands $[Fe(CN)_6]^{-4}$
$[Fe(CN)_6]^{-3}$
$[Ru(CN)_6]^{-4}$
$[Ru(CN)_5F]^{-4}$
$[Ru(CN)_4F_2]^{-4}$
$[Ru(CN)_5Cl]^{-4}$
$[Ru(CN)_4Cl_2]^{-4}$
$[Ru(CN)_5(OCN)]^{-4}$
$[Ru(CN)_5(SCN)]^{-4}$
$[Re(CN)_6]^{-4}$ $[Re(CN)_5Br]^{-4}$
$[Re(CN)_4Br_2]^{-4}$
$[Os(CN)_6]^{-4}$
$[Os(CN)_5I]^{-4}$
$[Os(CN)_4I_2]^{-4}$
$[Ir(CN)_6]^{-3}$
$[Ir(CN)_5(N_3)]^{-3}$
$[Ir(CN)_5(H_2O)]^{-3}$ Contents of at least one selected from the group consisting of metal complexes of Fe, Ru, Re, Os and Ir each comprising at least two cyan ligands preferably range from $10^{-6}$ mol to $10^{-3}$ mol, both inclusive, and more preferably from $5\times10^{-6}$ mol to $5\times10^{-4}$ mol, both inclusive, per one mol of the silver halide.

The metal complex comprising at least two cyan ligands used in the present invention may be contained in and added to the silver halide emulsion grains in any stages before and after preparation of them, i.e., the nucleation, growth, physical ripening and chemical sensitization. The metal complex may be added at once or at several times. In the present invention, 50% or more of the total contents of the metal complex comprising at least two cyan ligands contained in the silver halide grains is preferably contained in a surface layer of which volume is not higher than 50% of a grain volume. The term "surface layer of which volume is not larger than 50% of a grain volume" used herein means surface areas of which volume is not larger than 50% of a volume of one grain. The volume of the surface layer is preferably not larger than 40%, and more preferably not larger than 20%. In addition, one or more layers having no metal complex may be provided outside the surface layer containing the metal complex defined above.

The metal complex used is preferably dissolved in water or an adequate solvent and added directly to a reaction solution in formation of the silver halide grains. Alternatively, the metal complex may be incorporated to the grain by means of adding it to an aqueous solution of halogen compounds, an aqueous solution of silver or any other solution and thereby forming grains. In addition, the silver halide grains in which the metal complex is previously contained are added to and dissolved in a reaction solution to accumulate them on other silver halide grains. This also permits the latter silver halide grains to contain the metal complex.

In the present invention, pH of the coating of the silver halide color photographic photo-sensitive material corresponds to pH of all photographic structural layers obtained by means of applying a coating solution to a support and is thus not necessarily identical to pH of the coating solution. The pH of the coating can be measured through a following method disclosed in JP-A-61-245153. More specifically, (1) 0.05 ml of pure water is dropped to a surface of the photo-sensitive material to which the silver halide emulsion is applied. (2) After being let stand for three minutes, pH of the coating is measured by using a coating pH measuring electrodes (GS-165F, available from TOA Electronics Ltd., Tokyo).

The photo-sensitive material according to the present invention has the so measured coating pH of from 4.0 to 6.5. Preferably, this pH ranges from 5.0 to 6.5.

The coating pH may be adjusted by using acid (e.g., sulfuric acid, citric acid, etc.) or alkali (e.g., sodium hydroxide, potassium hydroxide, etc.). While the acid or the alkali may be added to the coating solution by using any one of suitable methods, it is typically added to the solution in preparation thereof. In addition, the coating solution to which the acid or the alkali is added may be the solution for any one or more of the photographic structural layers.

Preferable mercapto heterocyclic compound used in the present invention is represented by the following general formula (V):

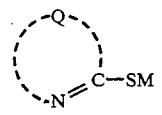

(V)

wherein Q represents atomic groups required for forming a five- or six-membered heterocyclic ring or five- or six-membered heterocyclic ring to which a benzene ring is condensed, and M represents a cation.

The compound having the general formula (V) is described more specifically.

A heterocyclic ring formed by Q may be, for example, an imidazole ring, a tetrazole ring, a thiazole ring, an oxazole ring, a selenazole ring, a benzoimidazole ring, a naphthoimidazole ring, a benzothiazole ring, a benzoselenazole ring, a naphthoselenazole ring or a benzoxazole ring.

A cation represented by M may be, for example, a hydrogen ion, alkali metals (such as sodium and potassium) or an ammonium group.

The compound represented by the general formula (V) is preferably a mercapto compound represented by one of the following general formulae (V-1), (V-2), (V-3) and (V-4).

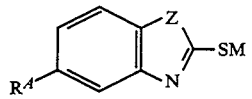

(V-1)

wherein $R^A$ represents a hydrogen atom, an alkyl group, an alkoxy group, an aryl group, a halogen atom, a carboxyl group or a salt thereof, a sulfo group or a salt thereof, or an amino group; Z represents —NH—, —OH— or —S—; and M is similar to that in the general formula (V).

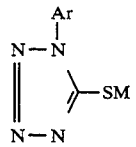

(V-2)

wherein Ar represents

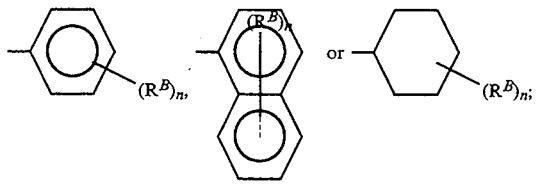

$R^B$ represents an alkyl group, an alkoxy group, a carboxyl group or a salt thereof, a sulfo group or a salt thereof, a hydroxyl group, an amino group, an acylamino group, a carbamoyl group or a sulfamide; n represents an integer of from from 0 to 2; and M is similar to that in the general formula (V).

In the general formulae (V-1) and (V-2), the alkyl group represented by $R^A$ and $R^B$ includes, for example, methyl, ethyl and butyl. The alkoxy group represented by $R^A$ and $R^B$ includes, for example, methoxy and ethoxy. A salt of the carboxyl group or the sulfo group includes, for example, a sodium salt and an ammonium salt.

In the general formula (V-1), the aryl group represented by $R^A$ includes, for example, phenyl and naphthyl while the halogen atom represented by $R^A$ includes, for example, a chloride atom and a bromide atom.

In the general formula (V-2), the acylamino group represented by $R^B$ includes, for example, methylcarbonylamino and benzoylamino while the carbamoyl group represented by $R^B$ includes, for example, ethylcarbamoyl and phenylcarbamoyl. The sulfamide represented by $R^B$ includes, for example, methylsulfamido and phenylsulfamido.

The above mentioned alkyl, alkoxy, aryl, amino, acylamino, carbamoyl groups and the sulfamide may have one or more substituents. The substituent may be, in the amino group for example, the amino group of which alkylcarbamoyl group is substituted, i.e., an alkyl-substituted ureido group.

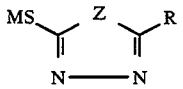

(V-3)

wherein Z represents —N($R^{A1}$)—, an oxygen atom or a sulfur atom. R represents a hydrogen atom, an alkyl group, an aryl group, an alkenyl group, a cycloalkyl group, —$SR^{A1}$—, —N($R^{A2}$)$R^{A3}$—, —$NHCOR^{A4}$—, —$NHSO_2$, $R^{A5}$ or a heterocyclic group; $R^{A1}$ represents a hydrogen atom, an alkyl group, an alkenyl group, a cycloalkyl group, an aryl group, —$COR^{A4}$ or —$SO_2$-$R^{A5}$; $R^{A2}$ and $R^{A3}$ each represents a hydrogen atom, an alkyl group or an aryl group; and $R^{A4}$ and $R^{A5}$ each represents an alkyl group or an aryl group. M is similar to that in the general formula (V).

In the general formula (V-3), the alkyl group of $R^{A1}$, $R^{A2}$, $R^{A3}$, $R^{A4}$ or $R^{A5}$ may be, for example, methyl, benzyl, ethyl or propyl, and the aryl group may be, for example, phenyl or naphthyl.

In addition, the alkenyl and cycloalkyl groups of R or $R^{A1}$ may be, for example, propenyl and cyclohexyl, respectively. The heterocyclic group of R may be, for example, furyl or pyridinyl.

The alkyl and aryl groups each represented by $R^{A1}$, $R^{A2}$, $R^{A3}$, $R^{A4}$ or $R^{A5}$, the alkenyl and cycloalkyl groups each represented by R or $R^{A1}$ and the heterocyclic group represented by R may have one or more substituents.

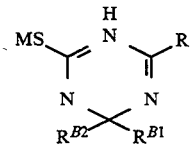

(V-4)

wherein R and M are same as R and M in the general formula (V-3), respectively; $R^{B1}$ and $R^{B2}$ are same as $R^{A1}$ and $R^{A2}$ in the general formula (V-3), respectively.

Specific examples of the compound represented by the general formula (V) are given below. It should be noted that the present invention is not limited to those specific examples.

V-1-1

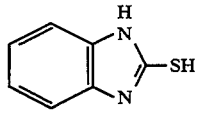

V-1-2

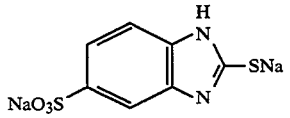

V-1-3

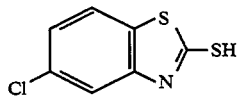

V-1-4

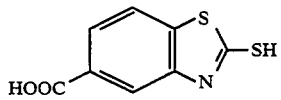

V-1-5

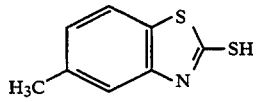

V-1-6

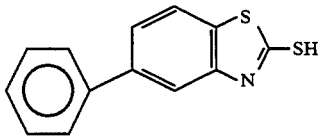

-continued
V-1-7
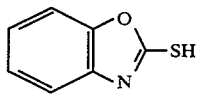
V-1-8
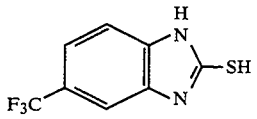
V-2-1
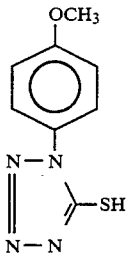
V-2-2
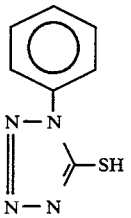
V-2-3
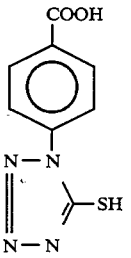
V-2-4
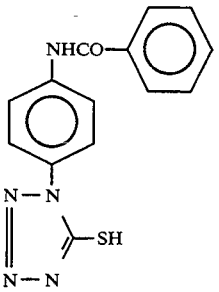
V-2-5
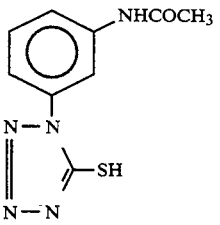

-continued
V-2-6
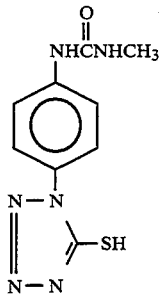
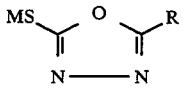
| COMPOUND | R | M |
|---|---|---|
| V-3-1 | $-C_2H_5$ | —H |
| V-3-2 | $-CH_2-CH=CH_2$ | —H |
| V-3-3 | $-CH=CH-CH_2-CH_3$ | —H |
| V-3-4 | $-C_7H_{15}$ | —H |
| V-3-5 | $-C_9H_{19}$ | —Na |
| V-3-6 | 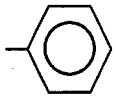 | —H |
| V-3-7 | $-C_4H_9(t)$ | —H |
| V-3-8 | 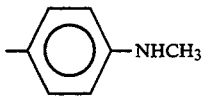 | —H |
| V-3-9 | 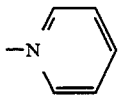 | —H |
| V-3-10 | 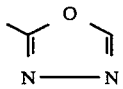 | —H |
| V-3-11 | 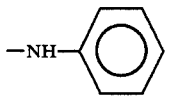 | —H |
| V-3-12 | 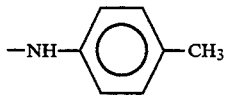 | $-NH_4$ |
| V-3-13 | $-NHCOCH_3$ | —H |
| V-3-14 | 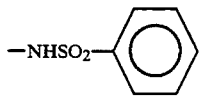 | —H |
| V-3-15 | $-N(CH_3)_2$ | —H |
| V-3-16 | 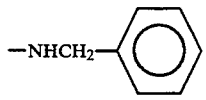 | —H |

-continued
| | | |
|---|---|---|
| V-3-17 | $-CH_2-$ 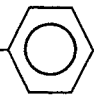 | —H |
| V-3-18 | $-S-CH_3$ | —H |
| V-3-19 | $-S-$ 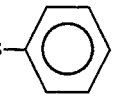 | —H |
| V-3-20 | —SH | —H |
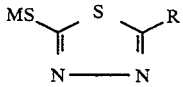
| COMPOUND | R | M |
|---|---|---|
| V-3-21 | —H | —H |
| V-3-22 | $-C_2H_5$ | —H |
| V-3-23 | $-C_4H_9(t)$ | —H |
| V-3-24 | $-C_6H_{13}$ | —H |
| V-3-25 | 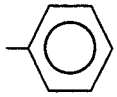 | —H |
| V-3-26 | 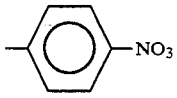 | —H |
| V-3-27 | 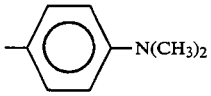 | —H |
| V-3-28 | 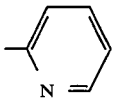 | —H |
| V-3-29 | 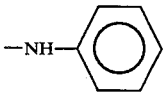 | —H |
| V-3-30 | $-NH_2$ | —H |
| V-3-31 | $-CH_2CH=CH_2$ | —H |
| V-3-32 | —SH | —H |
| V-3-33 | $-NHCOC_2H_5$ | —H |
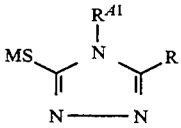
| COMPOUND | R | $R^{A1}$ | M |
|---|---|---|---|
| V-3-34 | $-C_2H_5$ | —H | —H |
| V-3-35 | $-CH_3$ | $-CH_3$ | —H |
| V-3-36 | $-CH_3$ | 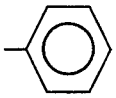 | —H |
| V-3-37 | $-NHCOCH_3$ | $-CH_3$ | —H |

-continued

| | | | |
|---|---|---|---|
| V-3-38 | —NHCO— 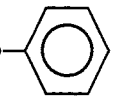 | —CO— 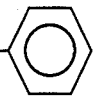 | —H |
| V-3-39 | —$NHCOCH_3$ | —$COCH_3$ | —H |
| V-3-40 | —$NHCOCH_3$ | —$CH_2$— 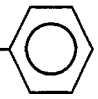 | —H |

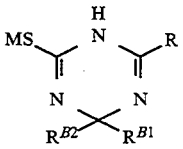

| COMPOUND | R | $R^{B1}$ | $R^{B2}$ | M |
|---|---|---|---|---|
| V-4-1 | —$C_2H_5$ | —$CH_3$ | —$CH_3$ | —H |
| V-4-2 | 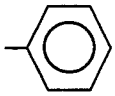 | —$CH_3$ | —$CH_3$ | —H |
| V-4-3 | —$NH_2$ | —H | 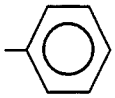 | —H |
| V-4-4 | —NH— 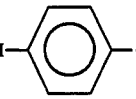 —Cl | —H | —$C_4H_9$ | —H |
| V-4-5 | —$NHCOCH_3$ | —$CH_3$ | —$CH_3$ | —H |
| V-4-6 | —NHCO— 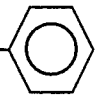 | —$CH_3$ | —$CH_3$ | —H |
| V-4-7 | —NH— 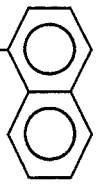 | —$CH_3$ | —$C_3H_7$(i) | —H |
| V-4-8 | 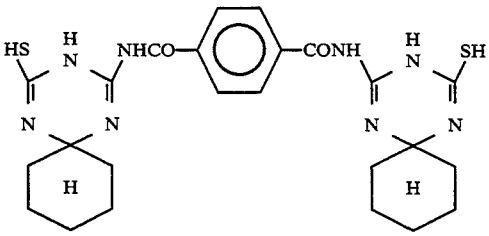 | | | |

An amount of the compound represented by the general formula (V) added is preferably from $1\times10^{-5}$ to $5\times10^{-2}$ mol, and more preferably from $1\times10^{-4}$ to $1\times10^{-2}$ mol, per one mol of the silver halide. A method of addition is not limited to a specific one and the compound may be added in any stages of formation of the silver halide grains, physical ripening, chemical ripening and preparation of the coating solution.

In the photo-sensitive material according to the present invention, it is preferable to add dyes adapted to be decolored by photographic processing (oxonol dyes or cyanine dyes), disclosed in European Patent Publication No. 0,337,490A2, pages 27–76, to a hydrophilic colloidal layer to avoid irradiation or halation and to improve safelight immunity. In addition, dyes that are contained in the hydrophilic colloidal layer in a form of a solid particle dispersion and that are decolored by the photographic processing may also be used advantageously. Such dyes include those disclosed in JP-A-2-282244, page 3, an upper right column to page 8, and those disclosed in JP-A-3-7931, page 3, an upper right column to page 11, a lower left column. These dyes, if used, preferably have such absorption that includes a spectral sensitivity maximum of a layer sensitive to a longest wavelength. To improve sharpness, it is preferable to use these dyes for setting an optical density (a logarithm of an inverse number of transmitted light) of the photo-sensitive material (or a reflection density if a reflecting material is used) at 680 nm or at a laser wavelength used for exposure to 0.5 or higher.

The photo-sensitive material according to the present invention preferably contains non-diffusion cyan, magenta and yellow couplers.

A high-boiling organic solvent for photographic additives such as the cyan, magenta and yellow couplers used in the present invention may be any one of adequate good solvents for couplers that is immiscible to water and has a melting point of not higher than 100° C. and a boiling point of not lower than 140° C. The melting point of the high-boiling organic solvent is preferably not higher than 80° C. The boiling point of the high-boiling organic solvent is preferably not lower than 160° C., and more preferably not lower than 170° C.

Details for such high-boiling organic solvent are disclosed in JP-A-62-215272, page 137, a lower right column to page 144, an upper right column.

The cyan, magenta or yellow coupler may be emulsified and dispersed in a hydrophilic colloidal solution by means of impregnating in a loadable latex polymer (e.g., U.S. Pat. No. 4,203,716) in the presence or absence of the above mentioned high-boiling organic solvent, or alternatively, by means of dissolving together with an insoluble and organic-solvent soluble polymer.

Preferably, a homopolymer or a copolymer is used as those disclosed in U.S. Pat. No. 4,856,449 and International Patent Publication No. WO 88/00723, pages 12–30. It is particularly preferable to use a methacrylate or acrylamide polymer, especially the acrylamide polymer by the consideration of color image stability.

In addition, it is preferable to use together with the couplers a color image storability improving compounds such as those disclosed in European Patent Publication No. 0,277,589A2. In particular, such improving compounds may be advantageously used with pyrazoloazole couplers or pyrroloazole couplers. More specifically, it is preferable, for preventing any adverse effects such as staining because of color generating dyes formed as a result of a reaction of the couplers with color developing agents left in the layer or oxidants thereof during storage after processing, to use single or a combination of a compound capable of chemically bonding to the aromatic amine developing agents left after color developing processing, thereby producing substantially colorless and chemically inactive compounds and/or a compound capable of chemically bonding to the oxidants of the aromatic amine developing agents left after color developing processing, thereby producing substantially colorless and chemically inactive compounds.

It is also preferable to add mildew proofing agents as disclosed in JP-A-63-271247 to the photo-sensitive material according to the present invention so as to eliminate the problem of mildew, or bacteria growing in the hydrophilic colloidal layer, which otherwise may be a cause of image deterioration.

As the support used for the photo-sensitive material of the present invention, a substrate may be used in which a white polyester support or a layer containing white dyes for displaying is provided on the support at the side having the silver halide emulsion layer. To further improve the sharpness, it is preferable to form by coating an anti-halation layer on the side coated with the silver halide emulsion layer or on the back side of the support. The transmission density of the support is preferably within the range from 0.35 to 0.8 to ensure a clear view on the display regardless of whether the light is a transmission light or a reflecting light.

The photo-sensitive material according to the present invention may be exposed to visible light or to an infrared ray. An exposure method may be a low illumination intensity exposure or a high illumination intensity-short time exposure. For the latter case, a laser scanning exposure is preferable in which an exposure time for one pixel is shorter than $10^{-4}$ seconds.

A band stop filter disclosed in U.S. Pat. No. 4,880,726 may advantageously be used in exposure. This eliminates light color amalgamation, resulting in remarkable improvement of color reproducibility.

The exposed photo-sensitive material is preferably subjected to bleach-fixing process after color development to achieve rapid processing. In particular, when the above mentioned high silver chloride emulsion is used, pH of a bleach-fixing solution is preferably not larger than 6.5, and more preferably not larger than 6 to enhance removal of silver.

Those disclosed in the published Japanese patent applications and the European Patent Publication No. 0,355,660 (JP-A-2-139544) are preferable examples of the silver halide emulsion, other materials (additives), photograph forming layers (layer structure or the like), and the methods and the processing additives applied to process the photo-sensitive material.

TABLE 1

| PHOTOGRAPH COMPONENTS | JP-A-62-215272 | JP-A-2-33144 | EP 355660 A2 |
|---|---|---|---|
| Silver Halide Emulsion | p. 10, l. 6 of URC to p. 12, l. 5 of LLC; and p. 12, 4th line from bottom of LRC to p. 13 l. 17 of ULC | p. 28, l .16 of URC to p. 29, l. 11 of LRC; and p. 30, ll. 2–5 | p. 45, l. 53 to p. 47 l. 3; and p. 47, ll. 20–22 |
| Silver Halide Solvent | p. 12, ll. 6–14 of LLC and p. 13, 3rd line from bottom of ULC to p. 18, last line of LLC | — | — |
| Chemical Sensitizer | p. 12, 3rd line from bottom of LLC to 5th line from bottom of LRC; and p. 18, l. 1 of LRC to p. 22, 9th line from bottom of URC | p. 29, ll. 12 to last line of LRC | p. 47, ll. 4–9 |
| Spectral Sensitizer (Spectral | p. 22, 8th line from bottom of URC to p. 38, | p. 30, ll. 1–13 of ULC | p. 47, ll. 10–15 |

TABLE 1-continued

| PHOTOGRAPH COMPONENTS | JP-A-62-215272 | JP-A-2-33144 | EP 355660 A2 |
|---|---|---|---|
| Sensitization) | last line | | |
| Emulsion Stabilizer | p. 39, l. 1 of ULC to p. 72, last line of URC | p. 30, l. 14 of ULC to l. 1 of URC | p. 47, ll. 16–19 |
| Development Accelerator | p. 72, l. 1 of LLC to p. 91, l. 3 of URC | — | — |

*ULC = upper left column;
URC = upper right column;
LLC = lower left column;
LRC = lower right column

TABLE 2

| PHOTOGRAPH COMPONENTS | JP-A-62-215272 | JP-A-2-33144 | EP 355660 A2 |
|---|---|---|---|
| Color Couplers (Cyan, Magenta, Yellow Couplers) | p. 91, l. 4 of URC to p. 121, l. 6 of ULC | p. 3, l. 14 of URC to p. 18, last line of ULC; and p. 30, l. 6 of URC to p. 35, l. 11 of LRC | p. 4, ll. 15–27; p. 5, l. 30 to p. 28, last line; p. 45, ll. 29–31; and p. 47, l. 23 to p. 63, l. 50 |
| Color Generation Accelerator | p. 121, l. 7 of ULC to p. 125, l. 1 of URC | — | — |
| Ultraviolet Light Absorbing Agent | p. 125, l. 2 of URC to p. 127, last line of LLC | p. 37, l. 14 of LRC to p. 38, l. 11 of ULC | p. 65, ll. 22–31 |
| Anti-fading Agent (Image Stabilizer) | p. 127, l. 1 of LRC to p. 137, l. 8 of LLC | p. 36, l. 12 of URC to p. 37, l. 19 Of ULC | p. 4, l. 30 to p. 5, l. 23; p. 29, l. 1 to p. 45, l. 25; p. 45, ll. 33–40; and p. 65, ll. 2–21 |
| High-boiling and/or Low-boiling Organic Solvent | p. 137, l. 9 of LLC to p. 144, last line of URC | p. 35, l. 14 of LRC to p. 36, 4th line from bottom of ULC | p. 64, ll. 1–51 |
| Dispersion Methods for Photographing Additives | p. 144, l. 1 of LLC to p. 146, l. 7 of URC | p. 27, l. 10 of LRC to p. 28, last line of ULC; and p. 35, l. 12 of LRC to p. 36, l. 7 of URC | p. 63, l. 51 to p. 64, l. 56 |

TABLE 3

| PHOTOGRAPH COMPONENTS | JP-A-62-215272 | JP-2-33144 | EP 355660 A2 |
|---|---|---|---|
| Hardening Agent | p. 146, l. 8 of URC to p. 155, l. 4 of LLC | — | — |
| Developing Agent Precursor | p. 155, l. 5 of LLC to p. 155, l. 2 of LRC | — | — |
| Development Inhibitor Releasing Compound | p. 155, ll. 3–9 of LRC | — | — |
| Support | p. 155, l. 19 of LRC to p. 156, l. 14 of ULC | p. 38, l. 18 of URC to p. 39, l. 3 of ULC | p. 66, l. 29 to p. 67, l. 13 |
| Photosensitive material Layer Structure | p. 156, l. 15 of ULC to p. 156, l. 14 of LRC | p. 28, ll. 1–15 of URC | p. 45, ll. 41–52 |
| Dye | p. 156, l .15 of LRC to p. 184, last line of LRC | p. 38, l. 12 of ULC to l. 7 of URC | p. 66, ll. 18–22 |
| Color Mixing Inhibitor | p. 185, l. 1 of ULC to p. 188, l. 3 of LRC | p. 36, ll. 8–11 of URC | p. 64, l. 57 to p. 65, l. 1 |
| Gradation Adjusting Agent | p. 188, ll. 4–8 of LRC | — | — |

TABLE 4

| PHOTOGRAPH COMPONENTS | JP-A-62-215272 | JP-A-2-33144 | EP 355660 A2 |
|---|---|---|---|
| Stain Inhibitor | p. 188, l. 9 of LRC to p. 193, l. 10 of LRC | p. 37, last line of ULC to l. 13 of LRC | p. 65, l. 32 to p. 66, l. 17 |
| Surfactant | p. 201, l. 1 of LLC to p. 210, last line of URC | p. 18, l. 1 of URC to p. 24, last line of LRC; and p. 27, 10th line from bottom of LLC to l. 9 of LRC | — |
| Fluorine-containing Compound (antistatic agent, coating aid, lubricant, adhesion inhibitor, etc.) | p. 210, l. 1 of LLC to p. 222, l. 5 of LLC | p. 25, l. 1 of ULC to p. 27, l. 9 of LRC | — |
| Binder (hydrophilic colloid) | p. 222, l. 6 of LLC to p. 225, last line of ULC | p. 38, ll. 8–18 of URC | p. 66, ll. 23–28 |
| Thickening Agent | p. 225, l. 1 of URC to p. 227, l. 2 of URC | — | — |
| Antistatic Agent | p. 227, l. 3 of URC to p. 230, l. 1 of ULC | — | — |

TABLE 5

| PHOTOGRAPH COMPONENTS | JP-A-62-215272 | JP-A-2-33144 | EP 355660 A2 |
|---|---|---|---|
| Polymer Latex | p. 230, l. 2 of ULC to p. 239, last line | — | — |
| Matte Agent | p. 240, l. 1 of ULC to p. 240, last line of URC | — | — |
| Photographic Processing Methods (process and | p. 3, l. 7 of URC to p. 10, l. 5 of URC. | p. 39, l. 4 of ULC to p. 42, last line of ULC | p. 67, l. 14 to p. 69, l. 28 |

TABLE 5-continued

| PHOTOGRAPH COMPONENTS | JP-A-62-215272 | JP-A-2-33144 | EP 355660 A2 |
|---|---|---|---|
| additives) | | | |

NOTE:
Citations from JP-A-62-215272 include the amended contents in the Amendment of March 16, 1987, printed at the end of this publication.
Also for the color couplers, it is preferable to use as the yellow coupler a so-called short-wave type yellow coupler disclosed in JP-A-63-231451, JP-A-63-123047, JP-A-63-241547, JP-A-1-173499, JP-A-1-213648 and JP-A-1-250944.

As the cyan coupler, other than diphenylimidazole cyan couplers disclosed in JP-A-2-33144, advantageously used are 3-hydroxypyridine cyan couplers disclosed in European Patent Publication No. 0,333,185 (in particular, preferable are a 2-equivalent coupler produced by means of adding a chloride removal group to a 4-equivalent coupler of a coupler (42) and couplers (6) and (9) disclosed as specific examples); cyclic active methylene cyan couplers disclosed in JP-A-64-32260 (in particular, couplers 3, 8 and 34 disclosed as specific examples are preferable); pyrrolopyrazole cyan couplers disclosed in European Patent Publication No. 0,456,226A1; pyrroloimidazole cyan couplers disclosed in European Patent No. 0,484,909; and pyrrolotriazole cyan couplers disclosed in European Patent No. 0,488,248 and European Patent Publication No. 0,491,197A1. Of these, the pyrrolotriazole cyan couplers are significantly preferable.

As the yellow coupler, other than the compounds set forth in the above Tables, advantageously used are acylacetoamide yellow couplers having a 3- to 5-membered ring structure at an acyl group disclosed in European Patent Publication No. 0,447,969A1; malondianilide yellow coupler having a ring structure disclosed in European Patent Publication No. 0,482,552A1; and acylacetoamide yellow couplers having a dioxane structure disclosed in U.S. Pat. No. 5,118,599. Of these, it is preferable to use acylacetoamide yellow couplers of which acyl group is 1-alkylcyclopropane-1-carbonyl group, and malondianilide yellow coupler in which one of anilides form an indoline ring. These couplers may be used solely or as a combination of two or more.

The magenta coupler used in the present invention may be 5-pyrazolone magenta couplers or pyrazoloazole magenta couplers disclosed in the articles set forth in the above Tables. Of these, advantageously used by the considerations of hues, image stability and color generation stability are pyrazolotriazole couplers disclosed in JP-A-61-65245 in which a secondary or tertiary alkyl group is directly bonded to a 2-, 3- or 6-coordinate of a pyrazolotriazole ring; pyrazoloazole couplers containing sulfamides in molecules disclosed in JP-A-61-65246; pyrazoloazole couplers having an alkoxyphenylsulfamideparasod disclosed in JP-A-61-147254; and pyrazoloazole couplers having an alkoxy group or an aryloxy group at a 6-coordinate disclosed in European Patent No. 226,849A.

As the color photo-sensitive material according to the present invention, other than those disclosed in the above Tables, preferable processing materials and processing methods are disclosed in JP-A-2-207250, page 26, line 1 of a lower right column to page 34, line 9 of an upper right column; and JP-A-4-97355, page 5, line 17 of an upper left column to page 18, line 20 of a lower right column.

The color developers used in the present invention preferably contain organic preservatives rather than hydroxylamine or sulfite ions.

The term "organic preservatives" used herein means any organic compounds having capabilities of reducing deterioration rate of the aromatic primary amine color developing agent when added to the processing solution for the color photographic photo-sensitive material. More specifically, the organic preservatives may be organic compounds having functions of avoiding oxidation of the color developing agent due to air or the like. Of these, particularly effective organic preservatives include hydroxylamine derivatives (except for hydroxylamine), hydroxamic acids, hydrazines, hydrazides, α-amino acids, phenols, α-hydroxyketones, α-aminoketones, sugars, monoamines, diamines, polyamines, quaternary ammonium salts, nitroxy radicals, alcohols, oximes, diamide compounds and condensed ring amines. These are disclosed in, for example, JP-B-48-30496 (the term "JP-B" as used herein means an "examined" Japanese patent publication), JP-A-52-143020, JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-1-97953, JP-A-1-186939, JP-A-1-186940, JP-A-1-187557, JP-A-2-306244, and European Patent Publication No. 0,530,921A1. In addition, as the preservatives, various metals disclosed in JP-A-57-44148 and JP-A-57-53749; salicylic acids disclosed in JP-A-59-180588; amines disclosed in JP-A-63-239447, JP-A-63-128340, JP-A-1-186939 and JP-A-1-187557; alkanolamines disclosed in JP-A-54-3532; polyethyleneimines disclosed in JP-A-56-94349; and aromatic polyhydroxy compounds disclosed in U.S. Pat. No. 3,746,544 may be used if necessary. In particular, it is preferable to add following compounds: alkanolamines such as triethanolamine, dialkylhydroxylamine such as N,N-diethylhydroxylamine and N,N-di(sulfoethyl)hydroxylamine, α-amino acid derivatives such as glycine, alanine, leucine, serine, threonine, valine, isoleucine and aromatic polyhydroxy compounds such as catechol-3,5-disulfonyl soda.

In particular, to use dialkylhydroxylamine together with alkanolamines, or to use dialkylhydroxylamine disclosed in European Patent Publication No. 0,530,921A1 together with alkanolamines and α-amino acids represented by glycine is preferable in view of improving stability of the color developer and improving stability in a continuous processing accordingly.

An amount of the preservatives added may be any one of suitable amounts for exhibiting functions of avoiding degradation of the color developing agents. The amount is preferably from 0.01 to 1.0 mol/liter, and more preferably from 0.03 to 0.30 mol/liter.

The present invention will be more readily apparent in the context of a specifically delineated set of examples and a reference. However, it should be understood that the present invention is not limited to those particular examples.

EXAMPLE 1

Silver halide emulsions were prepared in a manner described below. An average volume per one silver halide grain was determined according to colter countering. An average surface area per one silver halide grain was obtained based on an electron microphotograph thereof. In addition, a ratio of the surface area of the (111) planes to entire outer surface area of the silver halide grain was obtained according to the method disclosed above.

Preparation of Silver Chlorobromide Emulsion A 17.6 g of sodium chloride was added to 1600 ml of a lime-treated gelatin 3%-aqueous solution, to which an aqueous solution containing 0.094 mol of silver nitrate and an aqueous solution containing 0.12 mol of sodium chloride were added and mixed at 58° C. while stirring strongly. Subsequently, an aqueous solution containing 0.85 mol of silver nitrate and an aqueous solution containing 1.15 mol of sodium chloride were added to the resultant solution and mixed at 58° C. while stirring strongly. Then, desalting was performed by means of precipitation washing at 40° C. In addition, 90.0 g of lime-treated gelatin was added. Silver bromide fine grain emulsion having grain size of 0.07 μm was added to the resultant solution by an amount corresponding to of 0.005 mol of silver to form silver bromide rich areas on silver chloride host grains, following which a sulfur sensitizer, a selenium sensitizer and a gold sensitizer were added. The resultant mixture was subjected to optimum chemical sensitization at 60° C.

In this way, the silver chlorobromide emulsion A (cubic grains; average grain size: 0.50 μm (a diameter of a circle having an area that is equal to the projection area); average volume of volume load: 0.13 $\mu m^3$; fluctuation coefficient of grain size distribution: 0.08; average surface area: 1.5 $\mu m^2$; (111) ratio: 0%) was prepared.

Preparation of Silver Chlorobromide Emulsion B

A silver chlorobromide emulsion B was prepared in the same manner as the silver chlorobromide emulsion A except that 0.27 g of a compound 11 was added into the reaction vessel just after addition of the first aqueous solution of silver nitrate.

In this way, the silver chlorobromide emulsion B (tetradecahedral grains; average volume of volume load: 0.13 $\mu m^3$; fluctuation coefficient of grain size distribution: 0.09; average surface area: 1.5 $\mu m^2$; (111) ratio: 35%) was prepared.

Preparation of Silver Chlorobromide Emulsion C

A silver chlorobromide emulsion C was prepared in the same manner as the silver chlorobromide emulsion A except that 0.30 g of the compound 11 was added during formation of the silver chloride host grains.

In this way, the silver chlorobromide emulsion C (tetradecahedral grains; average volume of volume load: 0.13 $\mu m^3$; fluctuation coefficient of grain size distribution: 0.10; average surface area: 1.5 $\mu m^2$; (111) ratio: 70%) was prepared.

Preparation of Silver Chlorobromide Emulsion D

A silver chlorobromide emulsion D was prepared in the same manner as the silver chlorobromide emulsion A except that 0.46 g of the compound 11 was added during formation of the silver chloride host grains.

In this way, the silver chlorobromide emulsion D (octahedral grains; average volume of volume load: 0.13 $\mu m^3$; fluctuation coefficient of grain size distribution: 0.10; average surface area: 1.5 $\mu m^2$; (111) ratio: 100%) was prepared.

Preparation of Silver Chlorobromide Emulsion E

A silver chlorobromide emulsion E was prepared in the same manner as the silver chlorobromide emulsion A except that $K_4Fe(CN)_6$ was added into the sodium chloride solution of second addition by an amount corresponding to $2.0\times10^{-5}$ mol per one mol of silver halide product.

In this way, the silver chlorobromide emulsion E (cubic grains; average volume of volume load: 0.13 $\mu m^3$; fluctuation coefficient of grain size distribution: 0.08; average surface area: 1.5 $\mu m^2$; (111) ratio: 0%) was prepared.

Preparation of Silver Chlorobromide Emulsion F

A silver chlorobromide emulsion F was prepared in the same manner as the silver chlorobromide emulsion B except that $K_4Fe(CN)_6$ was added into the sodium chloride solution of second addition by an amount corresponding to $2.0\times10^{-5}$ mol per one mol of silver halide product.

In this way, the silver chlorobromide emulsion F (tetradecahedral grains; average volume of volume load: 0.13 $\mu m^3$; fluctuation coefficient of grain size distribution: 0.09; average surface area: 1.5 $\mu m^2$; (111) ratio: 35%) was prepared.

Preparation of Silver Chlorobromide Emulsion G

A silver chlorobromide emulsion G was prepared in the same manner as the silver chlorobromide emulsion C except that $K_4Fe(CN)_6$ was added into the sodium chloride solution of second addition by an amount corresponding to $2.0\times10^{-5}$ mol per one mol of silver halide product.

In this way, the silver chlorobromide emulsion G (tetradecahedral grains; average volume of volume load: 0.13 $\mu m^3$; fluctuation coefficient of grain size distribution: 0.10; average surface area: 1.5 $\mu m^2$; (111) ratio: 70%) was prepared.

Preparation of Silver Chlorobromide Emulsion H

A silver chlorobromide emulsion H was prepared in the same manner as the silver chlorobromide emulsion D except that $K_4Fe(CN)_6$ was added into the sodium chloride solution of second addition by an amount corresponding to $2.0\times10^{-5}$ mol per one mol of silver halide product.

In this way, the silver chlorobromide emulsion H (octahedral grains; average volume of volume load: 0.13 $\mu m^3$; fluctuation coefficient of grain size distribution: 0.10; average surface area: 1.5 $\mu m^2$; (111) ratio: 100%) was prepared.

Preparation of Silver Chlorobromide Emulsion I

A silver chlorobromide emulsion I was prepared in the same manner as the silver chlorobromide emulsion H except that $K_2IrCl_6$ was added into the sodium chloride solution of second addition by an amount corresponding to $4.0\times10^{-7}$ mol per one mol of silver halide product.

In this way, the silver chlorobromide emulsion I (octahedral grains; average volume of volume load: 0.13 $\mu m^3$; fluctuation coefficient of grain size distribution: 0.10; average surface area: 1.5 $\mu m^2$; (111) ratio: 100%) was prepared.

Preparation of Silver Chlorobromide Emulsion J

A silver chlorobromide emulsion J was prepared in the same manner as the silver chlorobromide emulsion H except that $K_4Ru(CN)_6$ was added into the sodium chloride solution of second addition by an amount corresponding to $2.0\times10^{-5}$ mol per one mol of silver halide product.

In this way, the silver chlorobromide emulsion J (octahedral grains; average volume of volume load: 0.13 $\mu m^3$; fluctuation coefficient of grain size distribution: 0.10; average surface area: 1.5 $\mu m^2$; (111) ratio: 100%) was prepared.

Preparation of Silver Chlorobromide Emulsion K

A silver chlorobromide emulsion K was prepared in the same manner as the silver chlorobromide emulsion H except that $K_4Os(CN)_6$ was added into the sodium chloride solution of second addition by an amount corresponding to $2.0\times10^{-5}$ mol per one mol of silver halide product.

In this way, the silver chlorobromide emulsion H (octahedral grains; average volume of volume load: 0.13 $\mu m^3$; fluctuation coefficient of grain size distribution: 0.10; average surface area: 1.5 $\mu m^2$; (111) ratio: 100%) was prepared.

Preparation of Silver Chlorobromide Emulsion L

A silver chlorobromide emulsion L was prepared in the same manner as the silver chlorobromide emulsion H except that $K_3Ir(CN)_6$ was added into the sodium chloride solution of second addition by an amount corresponding to $4.0\times10^{-5}$ mol per one mol of silver halide product.

In this way, the silver chlorobromide emulsion L (octahedral grains; average volume of volume load: 0.13 $\mu m^3$; fluctuation coefficient of grain size distribution: 0.10; average surface area: 1.5 $\mu m^2$; (111) ratio: 100%) was prepared.

Preparation of Silver Chlorobromide Emulsion M

A silver chlorobromide emulsion M was prepared in the same manner as the silver chlorobromide emulsion H except that $K_3RuCl_6$ was added into the sodium chloride solution of second addition by an amount corresponding to $2.0\times10^{-7}$ mol per one mol of silver halide product.

In this way, the silver chlorobromide emulsion M (octahedral grains; average volume of volume load: 0.13 $\mu m^3$; fluctuation coefficient of grain size distribution: 0.10; average surface area: 1.5 $\mu m^2$; (111) ratio: 100%) was prepared.

Preparation of Silver Chlorobromide Emulsion N

A silver chlorobromide emulsion N was prepared in the same manner as the silver chlorobromide emulsion H except that 0.34 g of a compound (24) was added rather than the Compound (11).

In this way, the silver chlorobromide emulsion N (octahedral grains; average volume of volume load: 0.13 $\mu m^3$; fluctuation coefficient of grain size distribution: 0.10; average surface area: 1.5 $\mu m^2$; (111) ratio: 100%) was prepared.

Preparation of Silver Chlorobromide Emulsion O

A silver chlorobromide emulsion O was prepared in the same manner as the silver chlorobromide emulsion H except that 0.41 g of a compound III-1 was added rather than the compound (11).

In this way, the silver chlorobromide emulsion O (octahedral grains; average volume of volume load: 0.13 $\mu m^3$; fluctuation coefficient of grain size distribution: 0.10; average surface area: 1.5 $\mu m^2$; (111) ratio: 100%) was prepared.

Preparation of Silver Chlorobromide Emulsion P

A silver chlorobromide emulsion P was prepared in the same manner as the silver chlorobromide emulsion H except that 2.2 g of a compound IV-7 was added rather than the compound (11).

In this way, the silver chlorobromide emulsion P (octahedral grains; average volume of volume load: 0.13 $\mu m^3$; fluctuation coefficient of grain size distribution: 0.11; average surface area: 1.5 $\mu m^2$; (111) ratio: 100%) was prepared.

Compositions of the silver chlorobromide emulsions A through P so prepared are set forth in Table 6 below.

TABLE 6

| Emulsion | Compound | Addition Amount (g) | (111) Plane Ratio | Metal Complex | Addition Amount (mol/1 mol of silver halide |
|---|---|---|---|---|---|
| A | | — | 0 | — | — |
| B | (11) | 0.27 | 35 | — | — |
| C | (11) | 0.30 | 70 | — | — |
| D | (11) | 0.46 | 100 | — | — |
| E | | — | 0 | $K_4Fe(CN)_6$ | $2.0\times10^{-5}$ |
| F | (11) | 0.27 | 35 | $K_4Fe(CN)_6$ | $2.0\times10^{-5}$ |
| G | (11) | 0.30 | 70 | $K_4Fe(CN)_6$ | $2.0\times10^{-5}$ |
| H | (11) | 0.46 | 100 | $K_4Fe(CN)_6$ | $2.0\times10^{-5}$ |
| I | (11) | 0.46 | 100 | $K_2IrCl_6$ | $4.0\times10^{-7}$ |
| J | (11) | 0.46 | 100 | $K_4RU(CN)_6$ | $2.0\times10^{-5}$ |
| K | (11) | 0.46 | 100 | $K_4OS(CN)_6$ | $2.0\times10^{-5}$ |
| L | (11) | 0.46 | 100 | $K_3Ir(CN)_6$ | $4.0\times10^{-5}$ |
| M | (11) | 0.46 | 100 | $K_3RUCl_6$ | $2.0\times10^{-7}$ |
| N | (24) | 0.34 | 100 | $K_4Fe(CN)_6$ | $2.0\times10^{-5}$ |
| O | III-1 | 0.41 | 100 | $K_4Fe(CN)_6$ | $2.0\times10^{-5}$ |
| P | IV-7 | 2.2 | 100 | $K_4Fe(CN)_6$ | $2.0\times10^{-5}$ |

Both surfaces of a paper support laminated with polyethylene were subjected to corona discharge. Sodium dodecylbenzenesulfonate was then added to gelatin, which was then coated on the surface as a base layer. Various photograph structure layers were coated thereon to make a multilayer color photographic printing paper (Sample 1) having the layer structure as set forth below. Coating solutions were prepared in the manner described below.

Preparation of First Layer Coating Solution 180 ml of ethyl acetate, 24.0 g of a solvent (solv-1) and 24.0 g of a solvent (solv-2) were added to dissolve 153 g of a yellow coupler (ExY), 15.0 g of a color image stabilizer (Cpd-1), 7.5 g of a color image stabilizer (Cpd-2) and 15.8 g of a color image stabilizer (Cpd-3). The resultant solution was added to 560 ml of a 18%-gelatin aqueous solution containing 60.0 ml of 10%-sodium dodecylbenzenesulfonate and 10 g of citric acid. The solution was then emulsified to prepare an emulsified dispersion A.

The above mentioned silver chlorobromide emulsion A and the emulsified dispersion A were mixed and dissolved. Prepared in this way the first layer coating solution has the formulation as set forth below.

The method used for preparing the first layer coating was also used to prepare the second through seventh layers. As the gelatin hardening agent, 1-oxy-3,5-dichloro-s-triazine sodium salt was used.

In addition, Cpd-15 and Cpd-16 were added to each layer in the total amounts of 25.0 mg/m$^2$ and 50.0 mg/m$^2$, respectively.

Spectral sensitizing dyes as set forth below were used as the silver chlorobromide emulsion for the individual sensitive emulsion layers.

TABLE 7

BLUE-SENSITIZING EMULSION LAYER

SENSITIZING DYE A

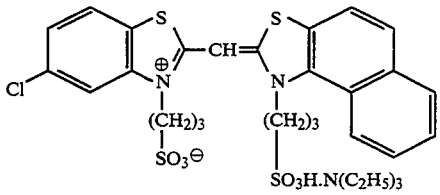

and

SENSITIZING DYE B

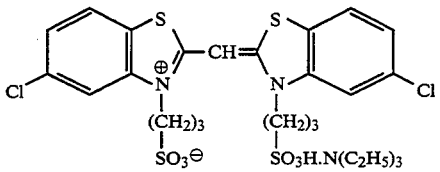

($2.5 \times 10^{-4}$ mol per 1 mol of silver halide for each)

TABLE 8

GREEN-SENSITIZING EMULSION LAYER

SENSITIZING DYE C

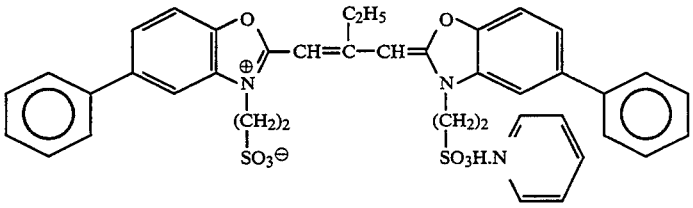

($4.0 \times 10^{-4}$ mol and $5.6 \times 10^{-4}$ mol per 1 mol of silver halide for the large-size and the small-size emulsions, respectively)

SENSITIZING DYE D

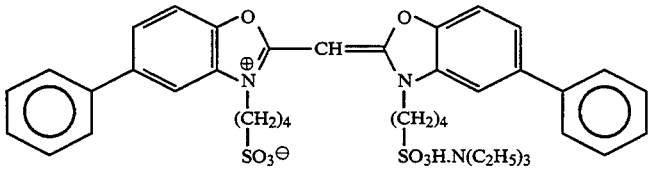

($7.0 \times 10^{-5}$ mol and $1.0 \times 10^{-4}$ mol per 1 mol of silver halide for the large-size and the small-size emulsions, respectively)

TABLE 9

RED-SENSITIZING EMULSION LAYER

SENSITIZING DYE E

TABLE 9-continued

RED-SENSITIZING EMULSION LAYER

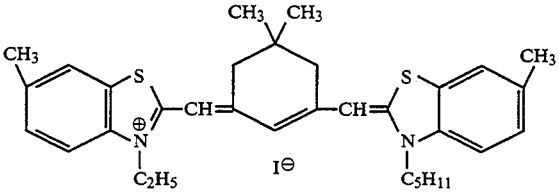

($0.9 \times 10^{-4}$ mol and $1.1 \times 10^{-4}$ mol per 1 mol of silver halide for the large-size and the small-size emulsions, respectively)

In addition, a following compound was added at $2.6 \times 10^{-3}$ mol per 1 mol of silver halide

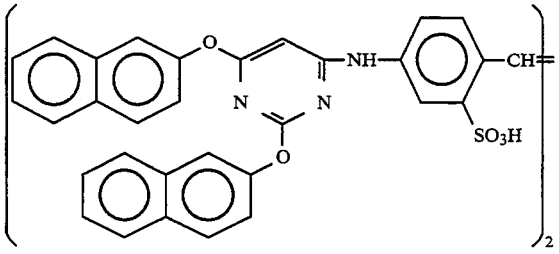

In addition, 1-(5-methylureidophenyl)-5-mercaptotetrazole was added to the green-, and red-sensitive emulsion layers at $7.7 \times 10^{-4}$ mol and $3.5 \times 10^{-4}$ mol, respectively, per 1 mol of silver halide.

Further, 4-hydroxy-6-methyl-1,3,3a,7-tetraazaindene was added to the blue-, green- and red-sensitive emulsion layers at $1 \times 10^{-4}$ mol, $2 \times 10^{-4}$ mol and $1.5 \times 10^{-4}$ mol, respectively, per 1 mol of silver halide.

Besides, dyes as set forth below were added to the emulsion layers to avoid irradiation. (The numerals within parentheses identify the amount of the dyes coated.)

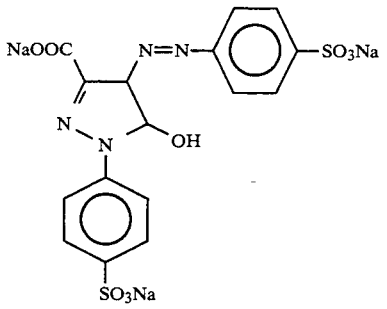

(10 mg/m²)

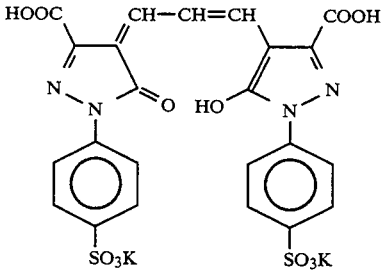

(10 mg/m²)

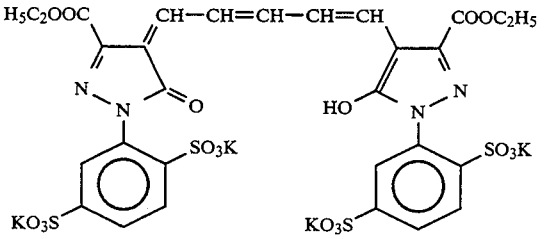

(40 mg/m²)

and

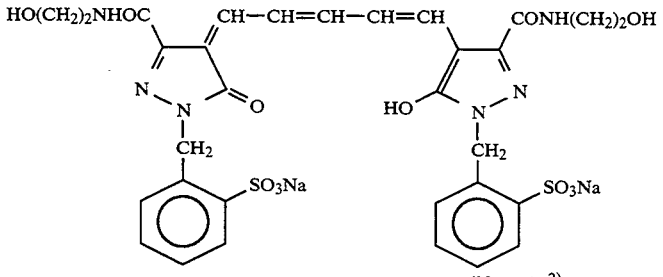

(20 mg/m²)

LAYER STRUCTURE

Formulations of the individual layers are set forth below. The numerals identify the coating amount (g/m²). The coating amount of the silver halide emulsion is converted into that of silver.

SUPPORT

Paper Laminated with Polyethylene (A white dye ($TiO^2$; contents 15% by weight) and a blue-tint dye (ultramarine blue) are contained in the polyethylene at the first layer side)

| FIRST LAYER (BLUE-SENSITIVE EMULSION LAYER) | |
|---|---|
| Silver Chlorobromide Emulsion | 0.27 |

-continued

| | |
|---|---|
| Gelatin | 1.36 |
| Yellow Coupler (ExY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.13 |
| Solvent (Solv-2) | 0.13 |
| SECOND LAYER (COLOR MIXING INHIBITING LAYER) | |
| Gelatin | 1.00 |
| Color Mixing Inhibitor (Cpd-4) | 0.06 |
| Color Image Stabilizer (Cpd-5) | 0.02 |
| Solvent (Solv-2) | 0.20 |
| Solvent (Solv-3) | 0.30 |
| THIRD LAYER (GREEN-SENSITIVE EMULSION LAYER) | |
| Silver Chlorobromide Emulsion (1:3 mixture (silver molar ratio) of a large-size | 0.13 |

-continued

| | |
|---|---|
| emulsion G1 and a small-size emulsion G2 having average grain sizes of 0.45 μm and 0.29 μm, respectively. Fluctuation coefficients of the grain size distribution were 0.08 and 0.10, respectively. In the emulsions, each silver halide grain consists of 0.8 mol % of silver bromide localized at a portion of surfaces of the grains and the remainder being silver chloride.) | |
| Gelatin | 1.50 |
| Magenta Coupler(EXM) | 0.16 |
| Color Image Stabilizer (Cpd-2) | 0.03 |
| Color Image Stabilizer (Cpd-6) | 0.15 |
| Color Image Stabilizer (Cpd-7) | 0.01 |
| Color Image Stabilizer (Cpd-8) | 0.02 |
| Color Image Stabilizer (Cpd-9) | 0.07 |
| Solvent (Solv-3) | 0.50 |
| Solvent (Solv-4) | 0.15 |
| Solvent (Solv-5) | 0.15 |
| **FOURTH LAYER (COLOR MIXING INHIBITING LAYER)** | |
| Gelatin | 0.70 |
| Color Mixing Inhibitor (Cpd-4) | 0.04 |
| Color Image Stabilizer (Cpd-5) | 0.02 |
| Solvent (Solv-2) | 0.18 |
| Solvent (Solv-3) | 0.18 |
| Solvent (Solv-7) | 0.02 |
| **FIFTH LAYER (RED-SENSITIVE EMULSION LAYER)** | |
| Silver Chlorobromide Emulsion (8:2 mixture (silver molar ratio) of a large-size emulsion R1 and a small-size emulsion R2 having average grain sizes of 0.5 μm and 0.4 μm, respectively. Fluctuation coefficients of the grain size distribution were 0.09 and | 0.20 |

-continued

| | |
|---|---|
| 0.10, respectively. In the emulsions, each silver halide grain consists of 0.8 mol % of silver bromide localized at a portion of surfaces of the grains and the remainder being silver chloride.) | |
| Gelatin | 0.85 |
| Cyan Coupler (EXC) | 0.33 |
| Ultraviolet Light Absorbing Agent (UV-2) | 0.18 |
| Color Image Stabilizer (Cpd-1) | 0.33 |
| Color Image Stabilizer (Cpd-8) | 0.01 |
| Color Image Stabilizer (Cpd-9) | 0.01 |
| Color Image Stabilizer (Cpd-10) | 0.16 |
| Color Image Stabilizer (Cpd-11) | 0.14 |
| Color Image Stabilizer (Cpd-12) | 0.01 |
| Solvent (Solv-1) | 0.01 |
| Solvent (Solv-6) | 0.22 |
| **SIXTH LAYER (ULTRAVIOLET LIGHT ABSORBING LAYER)** | |
| Gelatin | 0.55 |
| Ultraviolet Light Absorbing Agent (UV-1) | 0.38 |
| Color Image Stabilizer (Cpd-13) | 0.15 |
| Color Image Stabilizer (Cpd-6) | 0.02 |
| **SEVENTH LAYER (PROTECTIVE LAYER)** | |
| Gelatin | 2.13 |
| Copolymer of Polyvinyl alcohol denatured with acryl (denaturation rate; 17%) | 0.05 |
| Liquid Paraffin | 0.02 |
| Color Image Stabilizer (Cpd-14) | 0.01 |

The compounds used are set forth below.

(ExY) YELLOW COUPLER

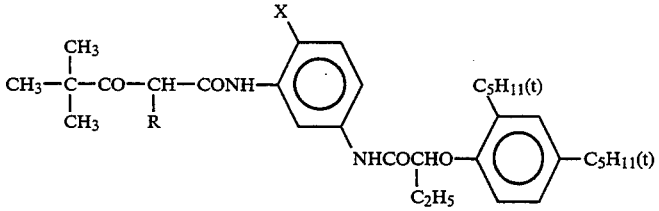

1:1:1 MIXTURE (MOLAR RATIO) OF:

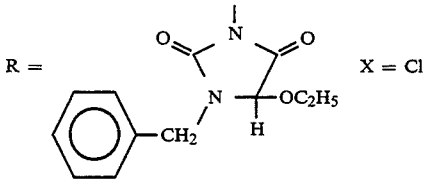

and

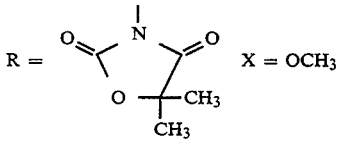

(ExM) MAGENTA COUPLER

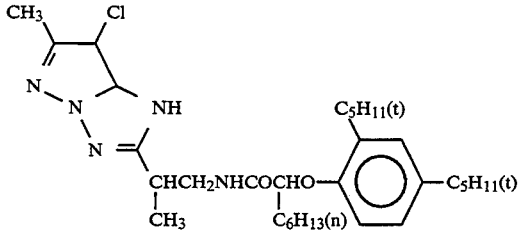

(ExC) CYAN COUPLER

-continued
3:7 MIXTURE (MOLAR RATIO) OF:
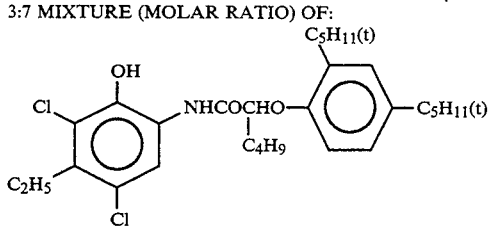
and
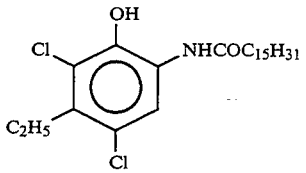
(Cpd-1) COLOR IMAGE STABILIZER
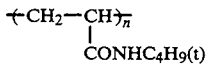
AVERAGE MOLECULAR WEIGHT 60,000
(Cpd-2) COLOR IMAGE STABILIZER
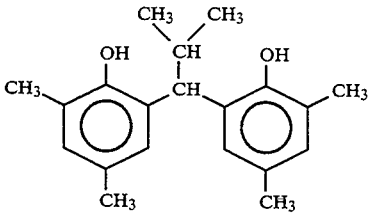
(Cpd-3) COLOR IMAGE STABILIZER
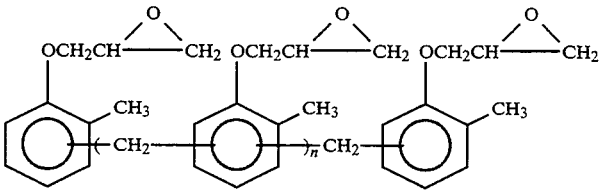
n = 7–8 (AVERAGE)
(Cpd-4) COLOR MIXING INHIBITOR
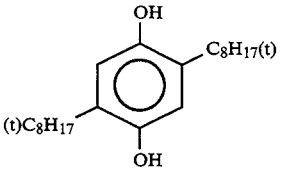
(Cpd-5) COLOR IMAGE STABILIZER
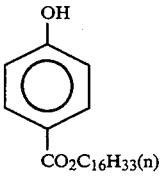

-continued
(Cpd-6) COLOR IMAGE STABILIZER
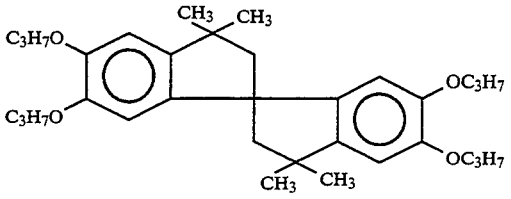
(Cpd-7) COLOR IMAGE STABILIZER
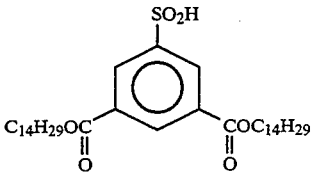
(Cpd-8) COLOR IMAGE STABILIZER
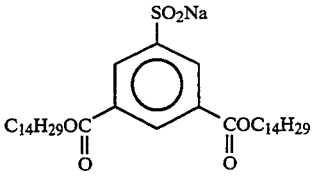
(Cpd-9) COLOR IMAGE STABILIZER
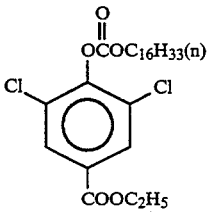
(Cpd-10) COLOR IMAGE STABILIZER
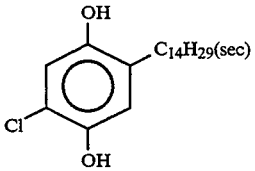
(Cpd-11) COLOR IMAGE STABILIZER
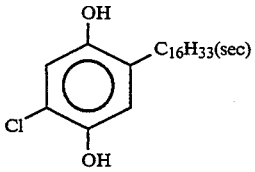
(Cpd-12) COLOR IMAGE STABILIZER
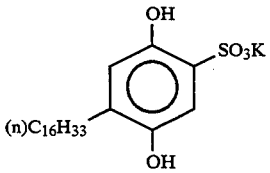
(Cpd-13) COLOR IMAGE STABILIZER -continued
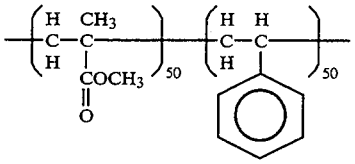
AVERAGE MOLECULAR WEIGHT
APPROX. $6.0 \times 10^4$
(Cpd-14) COLOR IMAGE STABILIZER
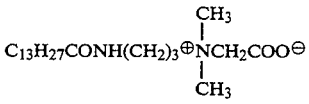
(Cpd-15) ANTISEPTIC
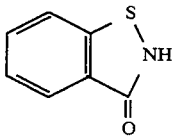
(Cpd-16) ANTISEPTIC
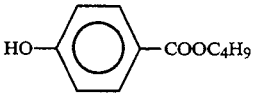
(UV-1) ULTRAVIOLET LIGHT ABSORBING AGENT
1:5:10:5 MIXTURE (WEIGHT RATIO) OF (1),(2),(3) AND (4)
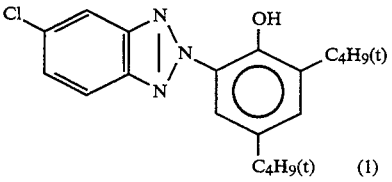
(1)
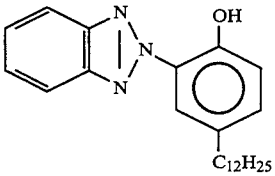
(2)
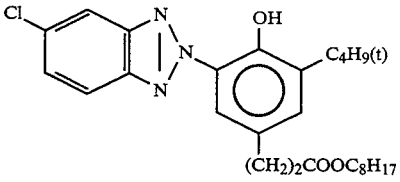
(3)
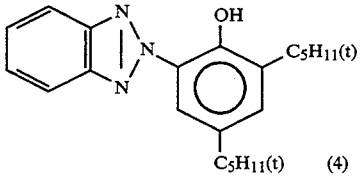
(4)
(UV-2) ULTRAVIOLET LIGHT ABSORBING AGENT -continued
1:2:2 MIXTURE (WEIGHT RATIO) OF (1),(2) AND (3)
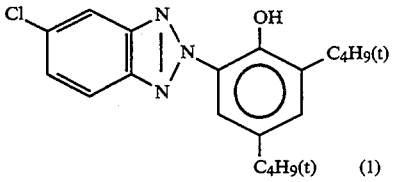
(1)
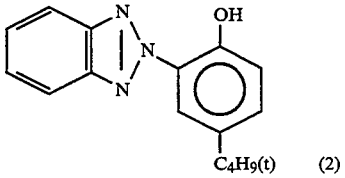
(2)
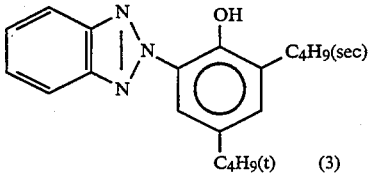
(3)
(Solv-1) SOLVENT
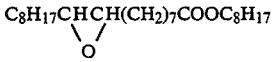
(Solv-2) SOLVENT
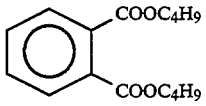
(Solv-3) SOLVENT
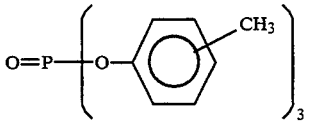
(Solv-4) SOLVENT
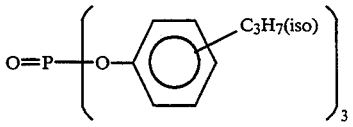
(Solv-5) SOLVENT
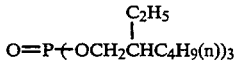
(Solv-6) SOLVENT
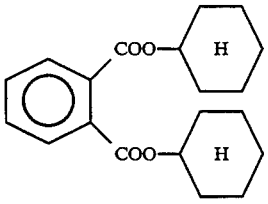

Samples were prepared by means of modifying Sample 1 so prepared in a type of the silver chlorobromide for the first layer (blue-sensitive emulsion layer), a type of the mercapto heterocyclic compound added to the first layer (blue-sensitive emulsion layer) and pH of the coating of the photo-sensitive material as set forth in Table 10 below.

TABLE 10

| Sample | Emulsion | Mercapto Hetero-cyclic Compound 1) | Coating pH | Sensitivity | ΔD | Fading Rate (%) | Remark |
|---|---|---|---|---|---|---|---|
| 1 | A | V-2-6 | 6.0 | 100 | 0.01 | ∘ | Comp. |
| 2 | B | V-2-6 | 6.0 | 132 | 0.02 | ∘ | Comp. |
| 3 | C | V-2-6 | 6.0 | 160 | 0.03 | ∘ | Comp. |
| 4 | D | V-2-6 | 6.0 | 182 | 0.05 | ∘ | Comp. |
| 5 | E | V-2-6 | 6.0 | 124 | 0.01 | ∘ | Comp. |
| 6 | F | none | 6.0 | 142 | 0.01 | ∘ | Inv. |
| 7 | G | V-2-6 | 6.0 | 182 | 0.01 | ∘ | Inv. |
| 8 | H | none | 3.8 | 180 | 0.03 | x | Comp. |
| 9 | H | none | 6.0 | 210 | 0.01 | x | Comp. |
| 10 | H | none | 6.7 | 220 | 0.05 | Δ | Comp. |
| 11 | H | V-2-6 | 3.8 | 200 | 0.03 | x | Comp. |
| 12 | H | V-2-6 | 6.0 | 226 | 0.01 | ∘ | Inv. |
| 13 | H | V-2-6 | 6.7 | 230 | 0.04 | ∘ | Comp. |
| 14 | I | V-2-6 | 3.8 | 176 | 0.03 | x | Comp. |
| 15 | I | V-2-6 | 4.8 | 178 | 0.02 | ∘ | Inv. |
| 16 | I | V-2-6 | 5.3 | 180 | 0.01 | ∘ | Inv. |
| 17 | I | V-2-6 | 6.2 | 185 | 0.01 | ∘ | Inv. |
| 18 | I | V-2-6 | 6.7 | 190 | 0.06 | ∘ | Comp. |
| 19 | J | none | 6.0 | 220 | 0.01 | x | Comp. |
| 20 | J | V-1-5 | 6.0 | 225 | 0.01 | ∘ | Inv. |
| 21 | J | V-2-5 | 6.0 | 230 | 0.01 | ∘ | Inv. |
| 22 | J | V-3-33 | 6.0 | 215 | 0.01 | ∘ | Inv. |
| 23 | J | V-4-6 | 6.0 | 220 | 0.01 | ∘ | Inv. |
| 24 | K | V-2-6 | 6.0 | 210 | 0.01 | ∘ | Inv. |
| 25 | L | V-2-6 | 6.0 | 190 | 0.01 | ∘ | Inv. |
| 26 | M | V-2-6 | 6.0 | 160 | 0.01 | ∘ | Inv. |
| 27 | N | V-2-6 | 6.0 | 220 | 0.01 | ∘ | Inv. |
| 28 | O | V-2-6 | 6.0 | 190 | 0.01 | ∘ | Inv. |
| 29 | P | V-2-6 | 6.0 | 200 | 0.01 | ∘ | Inv. |
| 30 | D | none | 6.0 | 180 | 0.06 | ∘ | Comp. |

1) Added $7 \times 10^{-4}$ mol per 1 mol of silver halide of the blue-sensitive layer
Comp.: Comparative Example
Inv.: Invention To determine the sensitivity of samples so prepared, each sample was subjected to exposure with an optical wedge and a blue filter for 1 second and then subjected to color generating development processing by using following processing process and processing solution. The sensitivity was represented as a relative value, wherein the sensitivity of Sample 1 is equal to 100 at an exposing degree required for producing a density 1.0 which is higher than the fogging density.

To evaluate increase of a yellow fogging density during a long-period storage of the photo-sensitive material, each sample was subjected to processing according to the following processing process for individual cases where the samples were stored in an atmosphere of 35° C./55% RH for 2 weeks and where the sample were stored in a refrigerator (10° C.) for the same period. In this event, the processing was made with 0.3 ml/liter of a bleach-fixing solution was incorporated into the color developer intentionally, assuming incorporation during practical color development. Increase of the yellow fogging density was represented as a difference (ΔD) between in the samples stored in the refrigerator and the samples stored in the atmosphere of 35° C./55% RH. The larger value indicates the higher yellow fogging density during a long-time storage of the photo-sensitive material.

To determine the pressure induced desensitization of the photo-sensitive material, it was folded before exposure at an angle of about 30° with the surface inside to which the photographic structural layers were applied, which was then subjected to the exposure and the processing. As evaluation to the pressure induced desensitization, samples folded before exposure were observed by human eyes and following evaluation was given.

O: no desensitization due to folding was found

Δ: desensitization due to folding was slightly found

×: desensitization due to folding was clearly found

| (Process) | (Temperature) | (Time) |
|---|---|---|
| Color Development | 35° C. | 45 sec. |
| Bleach-fix | 30–35° C. | 45 sec. |
| Rinse (1) | 30–35° C. | 20 sec. |
| Rinse (2) | 30–35° C. | 20 sec. |
| Rinse (3) | 30–35° C. | 20 sec. |
| Drying | 70–80° C. | 60 sec. |

Formulation of the processing solutions are as follows:

| [Color Developer] | |
|---|---|
| Water | 800 ml |
| Ethylenediamine-N,N,N-N-tetramethylenephosphonic acid | 1.5 g |
| Potassium bromide | 0.015 g |
| Triethanolamine | 8.0 g |
| Sodium Chloride | 1.4 g |
| Potassium Carbonate | 25.0 g |
| N-ethyl-N-(β-methanesulfonamideethyl)-3-methyl-4-aminoaniline sulfate | 5.0 g |
| N,N-bis(carboxymethyl)hydradine | 4.0 g |
| N,N-di(sulfoethyl)hydroxylamine.1Na | |
| Fluorescent Whitening Agent (WHITEX 4B, Sumitomo Chemical Co., Ltd.) | 1.0 g |
| Total (with added water) | 1000 ml |
| pH (25° C.) | 10.05 |

-continued

| [Bleach-fixing Solution] | |
|---|---|
| Water | 400 ml |
| Ammonium Thiosulfate (70%) | 100 ml |
| Sodium Sulfite | 17 g |
| Ethylenediaminetetraacetato Ferrite (III) Ammonium | 55 g |
| Ferrous Disodium Ethylenediamine Tetra acetate | 5 g |
| Ammonium Bromide | 40 g |
| Total (with added water) | 1000 ml |
| pH (25° C.) | 6.0 |
| [Rinse Solution] | |
| Ion Exchange Water (calcium and magnesium are each not higher than 3 ppm) | |

As apparent from Table 10, the high silver chloride emulsion that was subjected to grain formation in the presence of at least one grain growth controlling agent selected from the group consisting of the compounds represented by the general formulae (I), (II), (III) and (IV) is highly sensitive (all samples except for Samples 2 and 5). However, the photo-sensitive material to which this emulsion is applied is suffered from increase in fogging density during a long-time storage (Samples 3, 4, 8, 10, 11, 13, 14, 18 and 30). It has found that this increase of the fogging density could be reduced significantly by means of making the silver halide grains contain at least one selected from the group consisting of metal complexes of Fe, Ru, Re, Os, Rh and Ir and adjusting pH of the coating of the silver halide color photographic photo-sensitive material to 4.0 to 6.5. However, this also caused the pressure induced desensitization (Samples 9 and 19). It has revealed that the pressure induced desensitization had been improved significantly in the presence of at least one mercapto heterocyclic compound (Samples 12 and 20 through 29).

In addition, it is apparent that the sensitivity becomes extremely high when any one f the silver halide emulsions C, D, G and H through P comprising the grains having the (111)-plane ratio of 50% or higher as compared with a case where the emulsion A, B, E or F comprising the grains having the (111)-plane ratio of lower than 50%. Further, the higher sensitivity can be achieved at the higher pH.

EXAMPLE 2

The samples prepared in Example 1 were evaluated by using following processing process and processing solution. Effects of the present invention can be found as in Example 1.

| (Process) | (Temperature) | (Time) |
|---|---|---|
| Color Development | 35° C. | 45 sec. |
| Bleach-fix | 35° C. | 45 sec. |
| Stabilization (1) | 35° C. | 20 sec. |
| Stabilization (2) | 35° C. | 20 sec. |
| Stabilization (3) | 35° C. | 20 sec. |
| Stabilization (4) | 35° C. | 20 sec. |
| Drying | 80° C. | 60 sec. |

Formulation of the processing solutions are as follows:

| [Color Developer] | |
|---|---|
| Water | 800 ml |
| Poly(styrene lithium sulfonate) solution | 0.25 ml |
| 1-hydroxyethylidene-1,1-diphosphonic acid solution (60%) | 0.8 ml |

-continued

| | |
|---|---|
| Lithium Sulfate (anhydride) | 2.7 g |
| Triethanolamine | 8.0 g |
| Potassium Chloride | 1.8 g |
| Potassium Bromide | 0.03 g |
| Diethylhydroxylamine | 4.6 g |
| Glycine | 5.2 g |
| Threonine | 4.1 g |
| Potassium Carbonate | 27.0 g |
| Potassium Sulfite | 0.1 g |
| N-ethyl-N-(β-methanesulfonamideethyl)-3-methyl-4-aminoaniline.3/2 sulfuric acid.1 water salt | 4.5 g |
| Fluorescent Whitening Agent (4',4',-diaminostilbene) | 2.0 g |
| Total (with added water) | 1000 ml |
| pH (25° C.) (adjusted with potassium hydroxide and sulfuric acid) | 10.12 |
| [Bleach-fixing Solution] | |
| Water | 400 ml |
| Ammonium Thiosulfate (700 g/liter) | 100 ml |
| Sodium Sulfite | 17 g |
| Ethylenediaminetetraacetato Ferrite (III) Ammonium | 55 g |
| Ferrous Disodium Ethylenediamine Tetraacetate | 5 g |
| Glacial Acetic Acid | 9 g |
| Total (with added water) | 1000 ml |
| pH (25° C.) (adjusted with acetic acid and ammonium) | 5.40 |
| [Stabilizer] | |
| 1,2-Benzisothiazolin-3-one | 0.02 g |
| Polyvinylpyrrolidone | 0.05 g |
| Total (with added water) | 1000 ml |
| pH (25° C.) | 7.0 |

The silver halide color photographic photo-sensitive material according to the present invention achieves simultaneously the high sensitivity, the excellent storability and the improved pressure induced desensitization.

What is claimed is:

1. A silver halide color photographic photo-sensitive material comprising a reflective support having thereon photographic layers comprising one or more photo-sensitive silver halide emulsion layers, wherein the pH of a coating of the silver halide color photographic photo-sensitive material ranges from 4.0 to 6.5, and wherein at least one of the silver halide emulsion layers contains at least one mercapto heterocyclic compound and silver halide grains, said silver halide grains comprising silver chlorobromide or silver chloride and containing substantially no silver iodide, the silver halide grains having a silver chloride content of 80 mol % or higher, the silver halide grains being formed in the presence of at least one compound selected from the group consisting of compounds represented by the following general formula (I), (II), (III) and (IV), and the silver halide grains containing at least one compound selected from the group consisting of metal complexes of Fe, Ru, Re, Os and Ir,

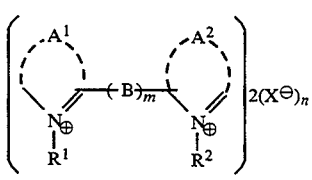

(I)

-continued (II)

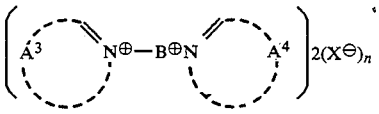

wherein $A^1$, $A^2$, $A^3$ and $A^4$ are the same as or different from each other and each represents a group of nonmetallic atoms necessary for completing a nitrogen-containing heterocyclic ring; B represents a divalent bonding group; m represents 0 or 1; $R^1$ and $R^2$ each represents an alkyl group; X represents an anion; and n represents 0 or 1, in which n represents 0 when the compound (I) or (II) is an inner salt, (III)

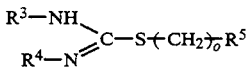

wherein $R^3$ and $R^4$ are the same or different from each other and each represents a hydrogen atom, an aryl group or an aralkyl group; $R^5$ represents an amino group, a sulfonic acid group or a carboxyl group; and o represents an integer of from 1 to 5, $$X—L^1—(S—L^2)p—X.qZ \quad (IV)$$

wherein X represents an amino group which may be substituted by an alkyl group, a quaternary alkyl ammonium group or a carboxyl group; $L^1$ and $L^2$ each represents a divalent organic group formed of a single or a combination of an alkylene group, an alkenylene group, $—SO_2—$, —SO—, —O—, —CO— or —N(R)— where R represents a hydrogen atom, an alkyl group, an aryl group or $—L^3—(S—L^4)p—X$, in which $L^3$ and $L^4$ each represents an alkylene group, an alkenylene group, $—S_2$, —SO—, —O—, or —CO—; p represents an integer of from 1 to 5; q represents an integer of from 0 to 3; and Z represents an anion, where q is equal in number to the quaternary alkyl ammonium groups as X.

2. A silver halide color photographic photo-sensitive material as claimed in claim 1, wherein 50% or more, based on an outer surface area, of said silver halide grains is constituted by (111) planes.

3. A silver halide color photographic photo-sensitive material as claimed in claim 1, wherein 80% or more of the total number of said silver halide grains is octahedral silver halide grains.

4. A silver halide color photographic photo-sensitive material as claimed in claim 1, wherein the metal complex is an Ir complex.

5. A silver halide color photographic photo-sensitive material as claimed in claim 1, wherein the metal complex has at least two cyano ligands.

6. A silver halide color photographic photo-sensitive material as claimed in claim 1, wherein the metal complex is present in the silver halide grains in an amount ranging from $10^{-9}$ mol to $10^{-2}$ mol per mol of silver halide.

7. A silver halide color photographic photo-sensitive material as claimed in claim 1, wherein the silver halide grains are formed in the presence of the compound represented by the general formula (I) or (III).

8. A silver halide color photographic photo-sensitive material as claimed in claim 1, wherein the silver halide grains are formed in the presence of at least one compound selected from the group consisting of the compounds represented by the general formulae (I), (II), (III) and (IV) in an amount ranging from $10^{-6}$ mol to $10^{-1}$ mol per mol of silver halide.

9. A silver halide color photographic photo-sensitive material as claimed in claim 1, wherein the mercapto heterocyclic compound is a compound represented by the following general formula (V):

(V)

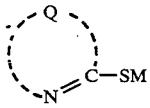

wherein Q represents atomic groups necessary for forming a five- or six-membered heterocyclic ring or five- or six-membered heterocyclic ring to which a benzene ring is condensed, and M represents a cation.

10. A silver halide color photographic photo-sensitive material as claimed in claim 1, wherein the mercapto heterocyclic compound represented by the general formula (V) is used in an amount ranging from $1\times10^{-5}$ mol to $5\times10^{-2}$ mol per mol of silver halide.

11. A silver halide color photographic photo-sensitive material as claimed in claim 1, wherein the silver chloride content in the silver halide grains is 99 mol % or higher.

12. A silver halide color photographic photo-sensitive material as claimed in claim 1, wherein the silver iodide content in the silver halide grains is lower than 1.0 mol %.

13. A silver halide color photographic photo-sensitive material as claimed in claim 2, wherein a ratio of the surface area of the (111) planes to the entire outer surface area is 80% or higher.

14. A silver halide color photographic photo-sensitive material as claimed in claim 3, wherein a ratio of the surface area of the (111) planes to the entire outer surface area is 90% or higher.

15. A silver halide color photographic photo-sensitive material as claimed in claim 1, wherein the pH of the coating ranges from 5.0 to 6.5.

* * * * *